US005352043A

United States Patent [19]

Takagaki et al.

[11] Patent Number: 5,352,043

[45] Date of Patent: Oct. 4, 1994

[54] SELF-SUPPORTING BAG, A METHOD OF PRODUCTION THEREOF AND AN APPARATUS FOR PRODUCTION THEREOF

[75] Inventors: Tadao Takagaki; Shizuo Hirose; Ikuo Tonouchi, all of Tokyo, Japan

[73] Assignee: Sumitomo Bakelite Co., Limited, Tokyo, Japan

[21] Appl. No.: 965,287

[22] PCT Filed: May 28, 1992

[86] PCT No.: PCT/JP92/00700

§ 371 Date: Jan. 29, 1993

§ 102(e) Date: Jan. 29, 1993

[87] PCT Pub. No.: WO92/21581

PCT Pub. Date: Dec. 10, 1992

[30] Foreign Application Priority Data

| | | | |
|---|---|---|---|
| May 29, 1991 | [JP] | Japan | 3-071298[U] |
| Jul. 3, 1991 | [JP] | Japan | 3-051203[U] |
| Nov. 1, 1991 | [JP] | Japan | 3-313271 |
| Apr. 7, 1992 | [JP] | Japan | 4-114117 |

[51] Int. Cl.[5] ..... B65D 30/16; B65D 30/20

[52] U.S. Cl. ..... 383/104; 383/119; 493/194

[58] Field of Search ..... 493/194, 195, 196, 197; 383/104, 119

[56] References Cited

U.S. PATENT DOCUMENTS

| | | | |
|---|---|---|---|
| 2,936,940 | 5/1960 | Berghgracht | 383/104 |
| 3,746,607 | 7/1973 | Harmon et al. | 383/119 |
| 3,980,225 | 9/1976 | Kan | 383/104 |
| 4,055,109 | 10/1977 | Kan | 493/196 |
| 4,076,121 | 2/1978 | Clayton et al. | 383/119 |
| 4,526,565 | 7/1985 | Hummel et al. | 493/196 |
| 4,837,849 | 6/1989 | Erickson et al. | 383/104 |
| 4,848,931 | 7/1989 | Kamada et al. | 383/104 |
| 4,925,438 | 5/1990 | Wagner | 493/194 |
| 4,997,416 | 3/1991 | Mitchell et al. | 493/194 |
| 5,048,977 | 9/1991 | Robbins | 383/104 |

FOREIGN PATENT DOCUMENTS

| | | | |
|---|---|---|---|
| 3925871 | 2/1991 | Fed. Rep. of Germany | 383/104 |
| 40-9704 | 5/1940 | Japan . | |
| 57-110039 | 7/1982 | Japan . | |
| 58-171845 | 11/1983 | Japan . | |
| 59-162440 | 10/1984 | Japan . | |

*Primary Examiner*—Stephen P. Garbe

*Attorney, Agent, or Firm*—Millen, White, Zelano, & Branigan

[57] ABSTRACT

A self-supporting bag comprising a part constituting the trunk and a part constituting the bottom both made of a multilayer plastic film comprising a heat adhesive plastic layer as the inner layer thereof is provided. The inner layer or the outer layer of the multilayer plastic film of the part constituting the trunk has a section comprising convex parts and concave parts adjacent with each other.

The linear ribs are formed by pressing a positive mold having linear protrusions at the top face against the multilayer plastic film to form linear troughs on the film with decrease of the thickness of the pressed part of the film and a raised part at the upper edges of the troughs on the film and by fixing the raised parts on the film.

30 Claims, 14 Drawing Sheets

SELF-SUPPORTING BAG, A METHOD OF PRODUCTION THEREOF AND AN APPARATUS FOR PRODUCTION THEREOF

FIELD OF THE INVENTION

The present invention relates to a novel self-supporting bag having good stiffness, excellent stability in its self-supporting properties and excellent shape holding properties and easy handling, and to a method of production thereof and as well as apparatus production thereof.

DESCRIPTION OF THE PRIOR ART

Self-supporting bags which can stand self-supported without falling down when the bags are charged with contents have been known. Examples of such known self-supporting bags are:

a so called doipack made by putting together a film constituting the trunk part and a film constituting the bottom part after folding them, followed by sealing the bottom part to a curved shape (to a shape of an arc);

a bag made by sealing parts for the bottom part made by folding two sheets of film forming the trunk parts faced with each other in such a way that films for the bottom part are combined together with an angle to form a single piece and the bottom face takes a square shape (for example, Laid Open Japanese Patent Application Showa 57-46750);

a bag made of a single sheet of film by folding the part forming the bottom to a W shape and then sealing the side part with an angle to form a square bottom part so that the bag has the self-supporting property (for example, Laid Open Japanese Patent Application Showa 56-123255); and a bag made by folding the part forming the side wall part of the bag with the gazette folding so that the bag has the self-supporting property (for example, Laid Open Japanese Patent Applications Showa 54-8072 and Showa 60-172656).

Among these bags, the doipack bag which is provided with the self-supporting property by filling the bag with a liquid material and the bag which has the bottom part of a square form are generally utilized. The bags in which the side wall part is made with the gazette folding are utilized mainly in combination with paper boxes or mainly for containing powder materials.

However, because the conventional self-supporting bags have insufficient stiffness at the upper parts of the bags in the filled condition, they have problems that stability and shape holding property are not sufficient and that amount of discharge of the content is not easily controlled because film of the trunk part is bent by the weight of the content during the discharge of the content.

For solving the problems described above, the film constituting the trunk part can be made thicker to give it more stiffness. However, this method has problems that a bag improved by simply increasing the thickness of the side walls is not easily handled as a bags and it is more like a stiff container than a bag, thus the favorable properties of bag containers such as flexibility being lost and that cost of producing the bag is increased.

As a method other than increasing thickness of the film, a method of effectively utilizing the sealed parts of the bag is known but this method has a limitation caused by the structure of the bag and has not been actually effective for solving the problems so far. Still another method was proposed in which structure of the self-supporting bag itself is changed in such a way that a constriction is formed at the trunk part of the bag to provide the bag with the self-supporting property (Laid Open Japanese Patent Application Showa 62-16345). However, the problem during the discharge of content remains unsolved by this method.

SUMMARY OF THE INVENTION

Extensive investigations undertaken by the present inventors with the objects described above lead to a discovery that a self-supporting bag having good stiffness, excellent stability of the self-supporting property and excellent shape holding property can be produced by making both of the part constituting the trunk and the part constituting the bottom of the self-supporting bag with a multilayer plastic film, by forming the inner layer of the multilayer plastic film with a heat adhesive layer and by forming a section comprising convex parts and concave parts adjacent with each other and a surface having linear ribs of a shape of a vertical line, an oblique line, a horizontal line, a curved line or a combination thereof in the inner layer or the outer layer of the multilayer plastic film of the part constituting the trunk.

It is not easy that the linear ribs are formed on a thin plastic film efficiently and no method for forming such ribs has been developed.

Naturally, no efficient method of production of a self-supporting bag by producing the plastic film having linear ribs and then by producing the self-supporting .bag from the thus produced plastic film having linear ribs has been developed.

Extensive investigations undertaken by the present inventors with the objects described above lead to a discovery that, when a positive mold having linear protrusions at the top face is pressed against a multilayer plastic film and linear troughs are formed by decreasing the thickness of the pressed part of the multilayer plastic film, raised parts of the plastic film are formed at the upper edge parts of the troughs, that the linear ribs can be formed on the multilayer plastic film by fixing the raised parts of the film and that the self-supporting bag can be efficiently produced by utilizing the multilayer plastic film having linear ribs thus produced.

Thus, the present invention has an object of providing a self-supporting bag having good stiffness, excellent stability of the self-supporting property and excellent shape holding property when the bag is filled with a content, particularly with liquid or a fluid material and easily handled.

The present invention has other objects of providing a method of production of the self-supporting bag having linear ribs by which the bag can be efficiently produced and providing an apparatus of production thereof.

GENERAL DESCRIPTION OF THE INVENTION

The present invention provides a self-supporting bag comprising a part constituting the trunk and a part constituting the bottom both made of a multilayer plastic film comprising a heat adhesive plastic layer as the inner layer thereof. The inner layer or the outer layer of the multilayer plastic film of the part constituting the trunk has a section comprising convex parts and concave parts and a surface having linear ribs of a shape of a vertical line, an oblique line, a horizontal line, a curved line or a combination thereof.

The present invention also provides a method of production of the self-supporting bag having linear ribs comprising a process (1) in which linear ribs are formed on a multilayer plastic film comprising a heat adhesive plastic layer at the surface by pressing a positive mold having linear protrusions at the top face against the multilayer plastic film to form linear troughs on the film with decrease of the thickness of the pressed part of the film and raised parts at the upper edges of the troughs on the film and by fixing the raised parts on the film, a process (2) in which more than one of the multilayer plastic films having linear ribs or the multilayer plastic film having linear ribs and another multilayer plastic film are put together in such a way that the heat adhesive plastic layers are placed between the layers, a process (3) of heat sealing the multilayer plastic films having the linear ribs thus put together to form the shape of the bag and a process (4) in which the bag is cut out from the heat sealed multilayer plastic films having the linear ribs.

The present invention further provides an apparatus of production of a self-supporting bag having linear ribs comprising means (1) of producing a multilayer plastic film having linear ribs comprising a means of positive molding which comprises a positive mold having linear protrusions at the top face, a means of supplying a material which supplies a multilayer plastic film comprising a heat adhesive plastic layer as the surface layer to the means of positive molding and a means of fixing raised parts on the multilayer plastic film which are formed by pressing the linear protrusions of the positive mold to the multilayer plastic film; means (2) of putting together two or more of the multilayer plastic film having linear ribs or the multilayer plastic film having linear ribs and another multilayer film in such a way that the heat adhesive plastic layers are placed between the layers; means (3) of heat sealing the multilayer plastic films thus put together to form the shape of the bag and means (4) of cutting out the bag from the heat sealed multilayer plastic film.

Because the linear rib formed on the part constituting the trunk of the self-supporting bag of the invention has a structure that a linear furrow is accompanied along the linear trough, the bag is easily bent along the linear trough and provided with an excellent stiffness by the linear furrow. Thus, the linear rib exhibits excellent effect of satisfying the stiffness and the shape holding property simultaneously.

According to the present invention, because the self-supporting bag has the linear ribs providing the film of the trunk part of the bag with stiffness, the kinking phenomenon which is observed on conventional self-supporting bags is not observed during discharge of the content or during handling of the bag and the self-supporting bag having very excellent self-supporting property and very excellent shape holding property can be obtained. When the linear ribs are formed on the outer layer of the self-supporting bag, the effect of the sliding property can be observed as well. Because of these properties, the self-supporting bag of the invention is very easy to handle. The self-supporting bag of the invention exhibits the same excellent effects when the content is a powder material or a mixture of a liquid material and a solid material as well as a liquid material.

By utilizing the apparatus of producing the self-supporting bag having linear ribs of the invention, the linear ribs can be formed very easily and the process of the formation of the linear ribs is easily made a part of the production line of the bag. Thus, the self-supporting bag can be produced efficiently.

BRIEF DESCRIPTION OF THE DRAWINGS

Various other objects, features and attendant advantages of the present invention will be more fully appreciated as the same becomes better understood when considered in conjunction with the accompanying drawings, in which like reference characters designate the same or similar parts throughout the several views, and wherein.

DETAILED DESCRIPTION

Figure 1:
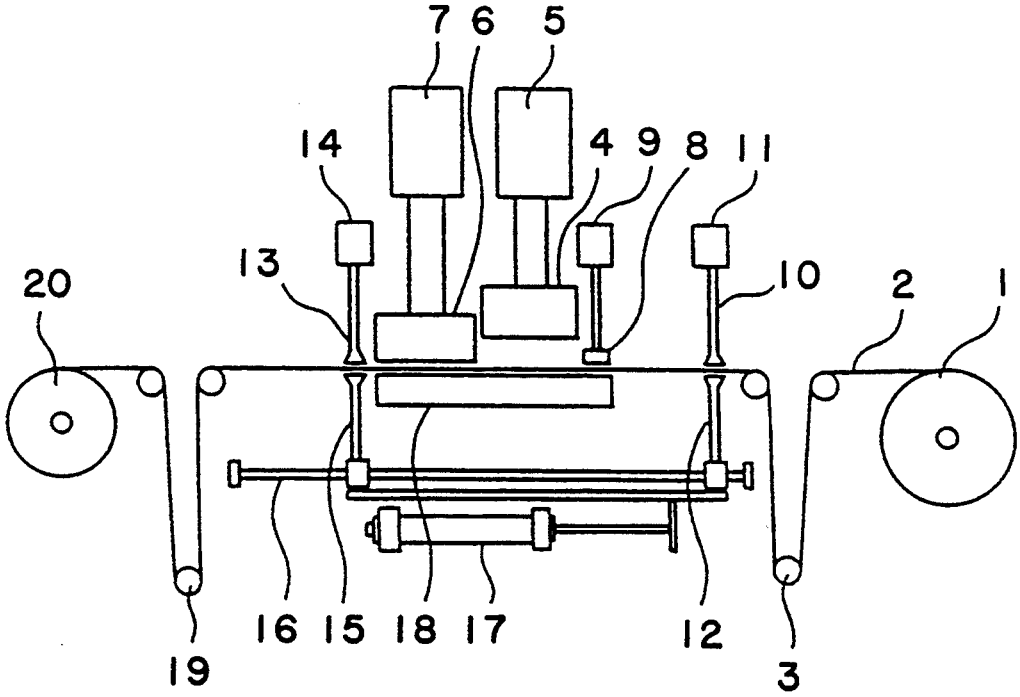
FIG. 1 is a diagram showing the outline of the apparatus of production of the multilayer plastic film having linear ribs utilized in the process (1) of the invention.

The numbers and characters in the figures have the meanings as listed in the following: 1: a material sheet roll of a multilayer plastic film; 2: a multilayer plastic film; 3: a dancer roll; 4: a positive mold; 5: a positive mold driver; 6: a cooling mold; 7: a cooling mold driver; 8: a holder; 9: a holder driver; 10: a clamp; 11: a clamp driver; 12: a clamp; 13: a clamp; 14: a clamp driver; 15: a clamp; 16: a clamp axis; 17: a clamp pitch mover; 18: a receiving table; 19: a dancer roll; 20: a winding roll; 21: a linear rib; 22: a linear furrow; 23: a linear furrow; 24: a linear raised part; 25: a linear trough; 26: a roll for changing direction; 27: a cutter; 28: a roll for changing direction; 29: a part constituting the bottom; 30: a roll; 31: a rubber roll; 32: a heat seal bar; 33: a heat seal bar driver; 34: a receiving table for heat sealing; 35: a cooling mold; 36: a punching blade; 37: a bag; 38: a roll; 39: a roll; 40: a roll; 41: a part constituting the trunk; 42: a part constituting the bottom; 43: a heat seal line; 44: a heat seal line; 45: a folding part; 46: a side seal line; 47: a constriction; 48: a cap; 49: a stopper; 50: liquid surface; 51: a pressing plate; 52: a heat insulating material; 53: a rib for guiding the content, and 54: holes through the sheet of material forming the bottom.

DESCRIPTION OF THE MOST PREFERRED EMBODIMENTS

The present invention is described in detail in the following.

The self-supporting bag of the present invention comprises a part constituting the trunk and a part constituting the bottom both made of a multilayer plastic film and the inner layer of the multilayer plastic film comprises a heat adhesive plastic layer.

Kind of the multilayer plastic film is not particularly limited so long as the inner layer comprises a heat adhesive plastic layer and various kinds of the multilayer plastic film can be utilized.

As the material of the heat adhesive plastic layer comprised in the inner layer of the multilayer plastic film, various kinds of plastic can be utilized. Examples of the material of the heat adhesive plastic layer are: polyolefins, such as polyethylene, polypropylene and the like; polyolefins containing chlorine, such as polyvinyl chloride and the like; aromatic vinyl polymers, such as polystyrene and the like; polyurethanes; polyesters, such as polyethylene terephthalate and the like; polyamides, such as nylon; polycarbonates; polyarylates; polyethers; copolymers of ethylene with a copolymerizable monomer, such as copolymers of ethylene and vinyl acetate, copolymers of ethylene and acrylic acid and the like; ionomers; and the like plastics. These materials may be utilized singly or as a combination of two or more kinds. When the part constituting the trunk and the part constituting the bottom are made of different kinds of the multilayer film, the inner heat adhesive plastic layers of the respective films may be made of the same kind of plastic or different kinds of plastic but they are preferably made of the same kind of plastic because of easier adhesion with each other.

The inner heat adhesive plastic layer may be a single layer or a multilayer comprising more than one layers.

As the multilayer plastic film, laminated films in which a film comprising the plastic described above and various kinds of other plastic is laminated to the heat adhesive plastic layer forming the inner layer can be utilized. A multilayer plastic film in which plastic films having different melting points are laminated together is preferable. When the multilayer plastic film comprising plastic films having different melting points is utilized and a linear protrusion is pressed against the plastic film having the lower melting point at a temperature close to the melting point of the plastic film having the lower melting point, the plastic film having the higher melting point does not melt and a linear trough can be formed exclusively on the layer of the plastic film having the lower melting point. The multilayer plastic film comprising plastic films having different melting points is preferably utilized also because excessive pressing of the linear protrusion to the film is less likely to cause cutting of the film.

When the multilayer plastic film comprises three layers or more and the inner layer and the outer layer are made of plastics having lower melting points than those of the intermediate layers, the protrusions can be pressed from the both sides of the multilayer plastic film to form linear troughs and the linear raised parts on the layers of the both sides simultaneously.

The difference of melting point is not particularly limited but preferably 10° C. or more, more preferably 20° C. or more and most preferably 30° C. or more.

Examples of the plastic film having the lower melting point are polyolefins, such as polyethylene, polypropylene and the like, and examples of the plastic film having the higher melting points are engineering plastic films, such as stretched nylon 6—6, stretched polyethylene terephthalate and the like.

For providing the multilayer plastic film with the barrier property, plastic films comprising aluminum foil, saponified copolymer of ethylene and vinyl acetate (EVOH), polyvinylidene chloride and the like can be utilized as the intermediate layer.

Soft laminated films made by laminating a film of a material other than the plastics, such as aluminum, paper and the like, to the heat adhesive layer of the inner layer may be utilized as the multilayer plastic film.

A multilayer plastic film printed on it can also be utilized.

Thickness of the multilayer plastic film is not particularly limited but generally in the range from 10 to 1000 μm, preferably in the range from 30 to 500 μm and more preferably in the range from 30 to 300 μm. Thickness of the heat adhesive plastic layer of the inner layer is not particularly limited either but preferably in the range from 20 to 300 μm and more preferably in the range from 50 to 250 μm.

In the self-supporting bag of the invention, the inner layer or the outer layer of the multilayer plastic film of the part constituting the trunk has a section of a shape in which concave parts and convex parts are placed adjacent with each other and a surface with linear ribs of a shape of a vertical line, an oblique line, a horizontal line, a curved line or a combination thereof.

Structure of the linear rib formed on the surface of the self-supporting bag of the invention is not particularly limited so long as it has a linear trough having the section of concave shape and linear furrows having the section of a convex shape which are placed adjacent with each other. The structure in which a linear trough is placed between two linear furrows is preferable.

Width of the linear trough having the section of a concave shape is generally in the range from 100 to 5000 μm and preferably in the range from 500 to 3000 μm. Depth of the linear trough is preferably within the thickness of the inner layer or the outer layer of the multilayer plastic film. However, the trough having a depth larger than the thickness of the inner heat adhesive layer or the outer layer may be formed within the range that the properties as the self-supporting bag are not adversely affected.

Height and width of the furrow of the linear rib formed on the surface of the self-supporting bag of the invention can be suitably selected according to the required stiffness. The height of the furrow is generally in the range from 20 to 500 μm and preferably in the range from 50 to 300 μm. The height described herein is the height from the surface of the plastic film having the linear ribs in the area excluding the ribs to the top of the furrow.

Surface shape of the linear rib is a shape of a vertical line, an oblique line, a horizontal line, a curved line or a combination thereof. Number of the rib is selected suitably according to the required properties. It may be one on one face of the part constituting trunk of the self-supporting bag or two or more and preferably in the range from 2 to 10. When the number of the rib is two or more, the robs may be separate or connected with each other.

For efficiently exhibiting the effect of the linear ribs, the surface shape of the linear rib is preferably arranged to the vertical direction (the vertical direction when the self-supporting bag is in the self-supporting condition). For further enhancing the effect of the linear ribs, linear ribs of oblique directions may be formed in combination with the vertical ribs. When the effect of the ribs to the horizontal direction is required, linear ribs of the horizontal direction can be formed without problem. Thus, the direction of the linear ribs can be suitably selected according to the requirement.

Though it is sufficient that the linear ribs are formed on one of the inner layer and the outer layer, they may be formed on the both of them. Though the linear ribs may be formed only on one of the two faces of the part constituting the trunk, they are preferably formed on the both faces.

Shapes of the part constituting the trunk and the part constituting the bottom of the self-supporting bag of the invention are not particularly limited so long as the self-supporting bag comprises the part constituting the trunk and the part constituting the bottom both made of the multilayer plastic film. For example, the bag may have the doipack shape, the gazette shape or the like. A shape having the same width at the bottom and the top, a shape having the width narrower at the top than the bottom or other shapes may be adopted.

In the self-supporting bag of the invention, it is preferred that the part constituting the bottom is folded in such a way that the part constituting the trunk and the part constituting the bottom form an approximate W shape. With this structure, the part constituting the bottom is expanded when a content is charged and stability of the self-supporting property of the bag can be obtained.

It is preferred that the self-supporting bag of the invention has side seal lines forming the side parts of the bag in such a way that the width of the upper part of the bag is narrower than the width of the folded part constituting the bottom of the bag described above. The width of the bag is the length between the inner sides of the two side seal lines forming the side parts of the bag to the direction parallel to the line of the bottom of the bag when the self-supporting bag is laid fiat without contents.

In the self-supporting bag having a narrower width at the top than at the bottom, the width at the top of the bag relative to the width at the bottom of the bag is not particularly limited so long as the width is narrower at the top than at the bottom. The width at the top of the bag is generally 90% or less, preferably in the range from 40 to 90%, more preferably in the range from 55 to 80% and most preferably in the range from 60 to 75% based on the width at the bottom of the bag.

The side seal line preferably has an oblique part at which the width of the bag is continuously made narrower. The description narrower means change of the width to the upward direction of the bag.

The oblique part of the side seal line at which the width of the bag is made continuously narrower may be formed over all parts or on a part of the side seal line forming the side part of the bag. It is formed preferably in the upper 30% or more and more preferably in the upper 40% or more of the height of the self-supporting bag.

It is preferred that the Width of the bag is kept about the same in the area from the bottom of the bag to the part where the oblique part of the side seal line begins. An oblique part forming increasing width of the bag may be comprised in the side seal line within the area.

When the width of the bag is continuously made narrower, the width may be made intermittently narrower as well as continuously narrower in the more strict meaning. However, it is preferred that the width is made continuously narrower in the more strict meaning. The oblique part may have a shape of a straight line, an approximate straight line, a broken line, a curved linear or a combinations thereof.

Width of the side seal line is not necessarily kept the same along all parts of the side seal line. It may be wider at the upper part of the bag. For keeping the stiffness, the minimum width is generally selected in the range from 2 to 10 mm and preferably in the range from 3 to 7 mm.

The stiffness of the self-supporting bag is further enhanced by the structure comprising the oblique part in which the width of the bag is continuously made narrower.

Width between the outer rims of the side seal lines may the same at the bottom and at the top of the bag.

The side seal line can be formed by various methods of adhesion. It is preferably formed by the heat sealing.

In the self-supporting bag of the invention, it is preferred that the side seal line forms a constriction part of the bag at a middle part of the self-supporting height of the bag.

When the self-supporting bag is charged with a content, the constriction part forms a convex part by the deformation toward the inside of the bag. Width of the bag in the constriction part is narrower than the width of the bag at one or both of the immediately upper part and the immediately lower part of the constriction part. The inner end of the side seal line at the constriction part is placed at an position inner from a straight line connecting the inner ends of the immediately upper part and the immediately lower part of the constriction part. The distance of the inner end of the side seal line at the constriction part from the straight line described above is measured by the distance between the inner end of the side seal line at the constriction and the straight line in the direction perpendicular to the straight line. The distance is not particularly limited but generally in the range from 2 to 15%, preferably in the range from 4 to 12% and more preferably in the range from 6 to 10% of the width of the bag at the constriction part. Number of the constriction part is at last one per one side seal line but may be more than one. It is preferred that constrictions are made symmetrically on both of the two side seal lines.

Position of the constriction part is at the middle part of the height of the self-supporting bag. The middle part is the part in the range from 30 to 80%, preferably in the range from 40 to 70% and more preferably in the range from 40 to 60% of the height of the self-supporting bag. The constriction part is preferably formed at the position where the oblique part described above begins but may be formed at another place.

Shape of the constriction part is not particularly limited but various shapes may be adopted, such as a shape of a broken straight line, a curved line like an arc and the like. The shape of a straight line broken at the middle is preferable among them.

The constriction part forms a convex part by the deformation toward the inside of the bag. By forming the constriction part on the self-supporting bag, the stiffness of the bag is further enhanced and the property of holding the shape of the self-supporting bag is also enhanced. Furthermore, the bag is more easily held by hands because it can be held by hands at the constriction part.

It is preferable that the self-supporting bag of the invention has linear ribs having a part curved to the shape of an approximate arc convex toward the inner direction and made on the surface of the part constituting the trunk at a position at about the same height as the constriction part and separated from the side seal line by about 10% or more of the width of the bag.

Because the linear rib is easily folded at the part of the linear trough, the end part of the convex part formed by the constriction part is formed by the folded linear trough when the content is charged to the bag. The shape of the convex part formed by the constriction part can be securely kept to the specified shape by this change of shape and thus the excellent self-supporting property can be achieved. Surface tension is generated in the area between the linear rib and the side seal and in the area between the linear ribs and the resistance against crushing can be increased.

Shape of the rib comprises a part curved to the shape of an approximate arc convex toward the inner direction. Curvature of the part curved to the shape of an approximate arc is not particularly limited but generally in the range from R5 to R100 (a radius in the range from 5 to 100 mm), preferably in the range from R5 to R80 and more preferably in the range from R10 to R50. The curvature is not necessarily the same over all parts of the curve.

Length of the part curved to the shape of an approximate arc can be suitably selected according to the size of the bag so that the effect described above can be exhibited. It is generally in the range from 1 to 20% and preferably in the range from 5 to 15% of the height of the bag.

Position of the part curved to the shape of an approximate arc of each linear rib is at about the same height as the constriction part and separated from the side seal line on the part constituting the trunk by about 10% or more of the width of the bag. About the same height as the constriction part means the position within ±20%, preferably in the range from +10 to −20% and more preferably in the range from 0 to −20% of the height of the constriction part.

Position of the part curved to the shape of an approximate arc of each linear rib is separated from the side seal line by about 10% or more, preferably by 15 to 40%, of the width of the bag.

Number of the linear rib may be one or more than one, preferably two, on one face of the part constituting the trunk. Though it is necessary that the linear ribs are formed at least on one of the faces of the part constituting the trunk, they are preferably formed symmetrically on the both faces.

It is preferred that the lower end of the linear rib is extended to the vicinity of the bottom area of the bag along the side seal line. Position of the lower part of the linear rib extended along the side seal line is separated from the side seal line to the inward direction preferably by 15to 40%, more preferably by 20 to 30%. Shape of the lower part of the linear rib extended along the side seal line is preferably a straight line or a curved line and more preferably a straight line.

It is preferred that the upper end of the linear rib is extended to the vicinity of the side seal line at the top of the bag. Position of the upper part of the linear rib extended toward the top of the bag is preferably within 15% from the side seal line to the inward direction. The shape of the upper part of the rib extended toward the top of the bag is preferably a straight line or a curved line.

The linear rib of the invention is preferably formed by pressing a positive mold having linear protrusions at the top face against the multilayer plastic film to form linear troughs on the film with decrease of the thickness of the pressed parts of the film and raised parts at the upper edges of the troughs on the film and by fixing the raised parts on the film. The bag is made easier to fold by the effect of the linear rib and stronger by the effect of the linear furrow and thus the self-supporting bag having the excellent stability of the self-supporting property can be produced.

The self-supporting bag of the invention preferably has heat seal parts having oblique inner sides placed between the ends of the folded part and the ends of the bottom so that the bottom part of the bag forms about hexagonal shape in the self-supporting condition.

The heat seal part having oblique inner sides is formed in the direction from the ends of the folded parts toward the ends of the bottom. The bottom of the self-supporting bag forms about hexagonal shape in the self-supporting condition by the effect of the oblique inner sides of the heat seal parts. The oblique inner sides of the heat seal parts are formed so that they constitute four edges of the hexagonal shape of the bottom. Though shape of the oblique part forming the inner sides of the heat seal part is not necessarily a straight line but may be a curved line, a shape of a straight line is preferable. Angle of the oblique inner sides can be suitably selected according to various requirements and is preferably in the range from 30 to 60 degrees.

The oblique inner sides of the heat seal parts are formed by heat sealing with or without folding of the part constituting the bottom.

The self-supporting bag of the invention preferably has heat seal parts having oblique inner sides placed between the ends of the folded part and the ends of the bottom so that the bottom takes about hexagonal shape in the self-supporting condition and heat seal parts having the inner sides curved to the shape of an arc of a curvature of R80 or more between the lower ends of the heat seal parts.

A reinforcing part of the bottom is formed along the peripheral edge of the bottom part of the bag by the heat seal part having the inner side curved to the shape of an arc. Because the inner side of the heat seal part is curved to the shape of an arc having the curvature of R80 or more, a concave part is not easily formed in the reinforcing part of the bottom and the reinforcing part of the bottom is not easily bent inward. Thus, the excellent stability of the self-supporting property can be obtained.

The curvature of the inner side of the heat seal part is suitably selected according to the width of the bottom of the bag within the range of R80 or more. It is preferably in the range from R80 to R500 and more preferably in the range from R100 to R300.

Height and width of the self-supporting bag of the invention are not particularly limited and bags of various sizes are suitably selected according to the required properties. The self-supporting bag of the invention has the excellent stability of the self-supporting property and the excellent property of holding the shape even when the size of the bag is considerably large. In the case of the self-supporting bag of the invention comprising the heat seal part having inner side curved to the shape of an arc of the curvature of R80 or more between the lower ends of the oblique heat seal parts, a bag of the size in the range from 80 to 200 mm is advantageously utilized.

It is preferred that the self-supporting bag of the invention has an outlet for content having linear ribs on the inner surface. These ribs have a similar structure as that of the linear rib described above. Guiding paths are secured at the outlet by forming the ribs on the inner surface of the outlet and the contents can be guided to the outlet of the content very easily.

The linear ribs for guiding content are formed on the surface of the outlet to the direction of discharging and shape of the guiding rib may be a straight line or a curved line.

Number of the linear rib for guiding content is not particularly limited but may be one or more than one.

The linear rib for guiding content may be formed only on one of the two inner faces of the bag but it is formed preferably on the both faces, more preferably symmetrically on the both faces.

Open part of the self-supporting bag is not necessarily made on the top of the bag but may be made on the side part of the bag. However, the open part is preferably made on the top of the bag.

The open part of the self-supporting bag may be sealed with heat sealing or by attaching a stopper with a cap.

When the open part of the self-supporting bag is made at the upper part of the bag, it is a preferable practice that content of the bag is securely contained without leaking by folding the upper part of the bag, followed by fixing the folded upper part of the bag by pinching it with a strip of film or a clip which is attached to the bag.

Furthermore, it is possible in the self-supporting bag of the invention that a notch for opening is formed on the top of the bag to facilitate the opening. It is also possible that a part like a fastener is attached to the opening part to form an opening of a reclosing type.

The method of production of the self-supporting bag having linear ribs of the invention is described in the following.

The method of production of the self-supporting bag having linear rib of the invention comprises the process (1) in which linear ribs are formed on a multilayer plastic film comprising a heat adhesive plastic layer at the surface by pressing a positive mold having linear protrusions at the top face against the multilayer plastic film to form linear troughs on the film with decrease of the thickness of the pressed part of the film and raised parts at the upper edges of the troughs on the film and by fixing the raised parts on the film.

In the process (1) , it is necessary that the positive mold having linear protrusion at the top face is pressed against the multilayer plastic film.

The multilayer plastic film utilized as the material of the process (1) may be supplied by cutting a long sheet of the multilayer plastic film supplied from a material sheet roll into two sheets to the longitudinal direction. The long sheet of the multilayer plastic film can be cut to the longitudinal direction at a suitable position according to the shape of the bag to be produced and it is generally preferable that the long sheet is cut along the central line of the original sheet of the multilayer plastic film for efficient utilization of the material sheet.

When the material multilayer plastic film is supplied in the manner as described above, the paths of the two sheets of the multilayer plastic film cut in the above process from the process (1) to the process (3) are preferably kept the same because bags having no misplaced printing on them can be produced more easily.

The linear ribs may be formed in the process (1) on one or both of the two sheets of the multilayer plastic film.

The positive mold utilized in the process (1) has the linear protrusions on the top face.

The linear protrusions form linear troughs on the multilayer plastic film with decrease of the thickness of the pressed parts of the film and raised parts at the upper edges of the troughs on the film by pressing them against the film.

It is necessary that the linear protrusion has such a height that a linear trough is formed on the multilayer plastic film and, at the same time, formation of the raised part at the upper edges of the trough is not hindered. The height is generally 0.3 mm or more and preferably in the range from 0.5 to 3 mm.

The linear protrusion has a width which can form the linear trough. The width is generally in the range from 0.5 to 5 mm, preferably in the range from 0.5 to 3 mm and more preferably in the range from 1 to 2 mm.

Shape of the section of the linear protrusion to the transverse direction of the protrusion generally has the same width at the top to the base of the protrusion or increasing widths from the top to the base of the protrusion so that the linear protrusion can be easily removed from the linear trough formed on the multilayer plastic film.

The top of the section of the linear protrusion to the transverse direction may have various kinds of shape, such as a curved line like circle, arc, a straight line and a combination thereof.

The linear protrusion may be a line of a straight shape, a line of a curved shape or two or more lines of these shapes.

The linear protrusion can be arranged in various ways. For example, two or more linear protrusions may be arranged parallel and close with each other; groups of linear protrusions arranged parallel and close with each other may be arranged with a space between them; two or more linear protrusions may be arranged with a space between them; two or more linear protrusions may be arranged with crossing with each other, forming rhombic shapes in some cases; and combined arrangements of these arrangements and the like other arrangements can be made.

As method of the pressing of the linear protrusions to the multilayer plastic film, cold compression, pressing with irradiation of ultrasonic wave, heat pressing and the like methods can be adopted. The heat pressing method is preferable among them.

When the linear protrusion is heated for pressing the multilayer plastic film, it is preferable that the linear protrusion is heated to the temperature above the melting point of the multilayer plastic film at the time of the pressing against the multilayer plastic film. Particularly, when the multilayer plastic film is a multilayer film formed by putting together plastic films having different melting points, the top of the linear protrusion of the positive mold is heated to a temperature higher than the melting point of the plastic film having the lower melting point and lower than the melting point of the plastic film having the higher melting point at the time of pressing against the layer of the plastic film having the lower melting point.

The positive mold is pressed against the multilayer plastic film for a time sufficient for forming the raised part on the film. The time is suitably selected according to the condition and generally in the range from 0.3 to 3 seconds, preferably in the range from 0.5 to 2 seconds.

By pressing the linear protrusion against the film, a linear trough is formed and a raised part is also formed at least on one side, generally on the both sides of the trough.

The linear protrusion may not be pressed against the multilayer plastic film so much that the film is cut off. It is necessary that the multilayer plastic film is continuous at the bottom of the trough. Thickness of the bottom of the trough can be suitably selected. It is preferred that the trough is formed in such a way the heat adhesive layer remains without being cut off.

In the process (1) of the invention, the raised part formed as described above is fixed.

The fixing of the raised parts can be made by various methods, such as cooling by standing, forced cooling by pressing with a cooling mold or by cooling with a cooling medium, pressing with a mold having a concave part for engaging with the furrow of the linear rib and a combination of these methods. The method of forced cooling is preferable among these methods because of higher efficiency of the production of the multilayer plastic film having linear ribs. Time of the forced cooling is suitably selected according to the kind of the multilayer plastic film and the condition of pressing of the positive mold.

The linear rib is formed on the multilayer plastic film by fixing the raised part.

Arrangement of the linear ribs in the invention is decided by the arrangement of the linear protrusion pressed against the multilayer plastic film. It is preferable that the linear ribs are arranged parallel with a specific distance between them. The distance between the linear ribs is not particularly limited but suitably selected according to the required stiffness and the shape of the linear ribs.

In the process (1), the method that the multilayer plastic film is laid on top of a flat mold and the linear protrusion is pressed against the multilayer plastic film from the above is preferable because the linear rib can be formed on one side of the film while the other side of the film is left flat.

The method that two sheets of the multilayer plastic film is pressed against the both sides of a positive mold having linear protrusions on the sides is also preferable because linear ribs are formed on the two sheets of the multilayer plastic film simultaneously.

The linear ribs can be formed on the multilayer plastic film by the methods described above. In the present invention, the linear ribs may be formed on one or or both sides of the multilayer plastic film.

A process of printing on the multilayer plastic film may be added before or after the process (1).

In the method of production of the self-supporting bag having linear ribs of the invention, the process (2) in which more than one of the multilayer plastic films with the linear ribs obtained in the process (1) or the multilayer plastic film with the ribs obtained in the process (1) and another multilayer plastic film are put together is comprised.

In the process (2), the multilayer plastic films which are put together in such a way that the heat adhesive plastic layer is placed between the layers may be made of separate sheets of the multilayer plastic film or of a single sheet of the multilayer plastic film which can be folded to make a double layer sheet. It is necessary that the linear rib is formed by the process (1) on at least one of the double layers made by folding the multilayer plastic film. The linear ribs are formed preferably on the both of the layers. The linear ribs may be formed on one or both of the faces of each multilayer plastic film. The ribs may be formed on the outer side, on the inner side or on the both of the inner and outer sides of the combined sheet made by putting together the multilayer plastic films.

In the process (2), a process in which a multilayer plastic film constituting the bottom part of the bag is attached to the end parts of the folded or to be folded multilayer plastic films having linear ribs may be added before or after the process (2) described above.

Method of folding the multilayer plastic film can be suitably selected according to the shape of the bag. Examples of the method are the method of simply folding two sheets of the multilayer plastic film, the method of folding the end parts so that they form a W shape and the like.

As the method of folding the multilayer plastic film in the process (2), it is preferred that the part constituting the bottom and the part constituting the trunk are put together in such a way that the parts of the bottom in the sheets forming the trunk part of the self-supporting bag made of the multilayer plastic film having the linear ribs formed in the process (1) can form an approximate W shape when they are folded in the longitudinal direction and that the heat adhesive plastic layer is placed to the inner side.

In the method of production of the self-supporting bag having linear ribs of the invention, the process (3) of heat sealing the multilayer plastic films having the linear ribs thus put together in the process (2) to form the shape of the bag is comprised.

The shape of the bag formed in the process (3) is not particularly limited. The bag can take various shapes so long as it is the self-supporting bag having the part constituting the trunk and the part constituting the bottom.

The heat sealing in the process (3) is made for the purpose of forming the shape of the bag described above and the shape of the heat seal may be selected suitably according to the shape of the bag.

In the method of production of the self-supporting bag having linear ribs of the invention, the process (4) in which the bag is cut out from the heat sealed multilayer plastic films having the linear ribs produced in the process (3) is comprised.

The cutting out of the bag in the process (4) can be made by various methods, such as by cutting with a cutting blades, by cutting with a melt cutting blade and the like. Shape of the cutting out can be selected suitably according to the shape of the bag made by the multilayer plastic film. Various shapes can be adopted, such as cutting in a shape of a straight line, cutting in a shape of a curved line, cutting by punching out and the like.

The process (3) and the process (4) may be performed simultaneously. When the two processes are performed simultaneously, it is preferable that the heat sealing and the cutting by melting are performed simultaneously by utilizing a heat seal blade or the heat sealing and the cutting is performed simultaneously by pressing the multilayer plastic film with a blade system having both of a heat seal blade and a cutting blade or a melt cutting blade in a manner that the heat seal blade and the cutting blade or the melt cutting blade are pressed simultaneously or in a manner that the heat seal blade is pressed and then the cutting blade or the melt cutting blade is pressed after a short time.

In the method of production of the self-supporting bag having linear ribs of the invention, it is preferable that the processes (1), (2), (3) and (4) are performed continuously for producing the bag because the bag can be produced efficiently.

When the self-supporting bag having linear ribs are produced continuously, it is preferable that the multilayer plastic film having linear ribs is produced continuously by utilizing a long sheet of the multilayer plastic film as the material film and by supplying the long sheet of the multilayer plastic film to the apparatus of forming the linear ribs continuously or intermittently. The long sheet of the multilayer plastic film can be supplied by various methods, such as winding it with a winding roll continuously or intermittently.

A preferred example of the method of production of the self-supporting bag having linear ribs of the invention is described in the following.

The preferred example of the method of production of the self-supporting bag having linear ribs comprises a process (1) in which linear ribs comprising linear troughs and linear furrows having a part curved to the shape of an approximate arc convex to the inward direction are formed on a multilayer plastic film comprising a heat adhesive plastic layer at the surface by pressing a positive mold having linear protrusions at the top face against the multilayer plastic film to form linear troughs on the film with decrease of the thickness of the pressed part of the film and raised parts at the upper edges of the troughs on the film and by fixing the raised parts on the film, a process (2) in which the part constituting the bottom and the part constituting the trunk are put together in such a way that the parts of the bottom in the sheets forming the trunk part of the self-supporting bag made of the multilayer plastic film having the linear ribs formed in the process (1) can form an approximate W shape when they are folded in the longitudinal direction and that the heat adhesive plastic layer is placed to the inner side, a process (3) in which side seals are formed on the film for the production of the self-supporting bag having the bottom part made of the films laid together to an approximate W shape in such a way that the width of the upper part of the self-supporting bag is 90% or less of the width of the bottom part of the bag made of the films laid together to an approximate W shape and the side seals form the side part of the bag having constriction part at the middle part of the self-supporting bag when the bag is in the condition of self-supporting and a process (4) in which a bag having the side seal lines is cut out from the film prepared in the process (3).

The linear ribs formed on the part constituting the trunk of the self-supporting bag of the invention are formed in the process (1).

Method of forming the linear ribs in the process (1) is the same as that in the method of production of the self-supporting bag of the invention described above.

Linear ribs having a part curved to the shape of an approximate arc concave to the inner direction can be formed by the process (1).

Then, the process (2) in which the part constituting the bottom and the part constituting the trunk are put together in such a way that the parts of the bottom in the sheets forming the trunk part of the self-supporting bag made of the multilayer plastic film having the linear ribs formed in the process (1) can form an approximate W shape when they are folded in the longitudinal direction and that the heat adhesive plastic layer is placed to the inner side-is performed.

The film for producing the self-supporting bag is a film comprising the part constituting the trunk and the part constituting the bottom. The self-supporting bag may comprise separate multilayer plastic films as the film for the part constituting the trunk and the film for the part constituting the bottom, a multilayer plastic film made by putting these two films together by adhesion, a multilayer plastic film made by folding a single multilayer plastic film to the form of a double structure sheet or a multilayer plastic film made of a cylindrical plastic film flattened to the form of a double structure sheet.

The linear ribs comprising the linear troughs and the linear furrows may be made on the inner side, on the outer side or on both sides of the self-supporting bag.

When the film for the production of the self-supporting bag comprises two sheets of film, the film for the production of the self-supporting bag can be prepared by various methods.

For example, when the long sheet of the film for the part constituting the trunk and the long sheet of the film for the part constituting the bottom are separate multilayer plastic films, the method in which end parts to the transverse direction of the two long sheets of the part constituting the trunk are put together by adhesion to the both end parts of the long sheet of the part constituting the bottom, the method in which end parts to the transverse direction of the two long sheets of the multilayer plastic film are put together by adhesion to form the part constituting the bottom in the area put together by adhesion and the like methods can be performed.

When the film for production of the self-supporting bag is made by folding a single sheet of the multilayer plastic film to the form of a double structure sheet, the method in which the part constituting the bottom is formed by the area of folding, the method in which separate end parts are put together by adhesion to form the part constituting the bottom by the area of the end parts, the method in which, to the end parts to the transverse direction of the long sheet of the multilayer plastic film for the parts constituting the trunk, the long sheet of the multilayer plastic film for the part constituting the bottom separately prepared is put together by adhesion and the like methods can be performed.

When the film for production of the self-supporting bag is made of a cylindrical plastic film flattened to the form of a double structure sheet, the area around the folded part can be made into the part constituting the bottom. Adhesion of the part constituting the bottom can be made by various methods and the adhesion by heat sealing is preferable among them. The heat sealing of the part constituting the bottom to the part constituting the trunk may be made simultaneously with the heat sealing in the next process of the production of the self-supporting bag.

In the method of production of the self-supporting bag, the heat sealing may be performed by the method of melt adhesion by ultrasonic wave, the method of adhesion by heating with an adhesive and the like methods as well as the method of heat sealing of the narrow meaning. The heat sealing of the narrow meaning is preferable among them.

The film for production of the self-supporting bag can be prepared by various methods as described above. The preferable method among them is the method of preparation of the part constituting the trunk and the part constituting the bottom from separate multilayer plastic films.

When the film for production of the self-supporting bag is prepared by putting together the end parts to the transverse direction of the long sheets of the part constituting the trunk to the both end parts to the transverse direction of the long sheet of the part constituting the bottom with a suitable width by adhesion, the part put together by adhesion works as a reinforcing part in the whole peripheral part of the bottom part which makes contact with the floor surface when the self-supporting bag is in the condition of self-supporting. When the part constituting the bottom and the part constituting the trunk are made of different kinds of the multilayer plastic film, thickness and kind of each plastic film can be varied separately to comply with various kinds of required properties. The width of the part put together by adhesion is preferably in the range from 2 to 10 mm.

Also in the case that other kinds of film are utilized as the film for production of the self-supporting bag, it is preferable that the part put together by adhesion described above is made on the whole periphery of the bottom part of the self-supporting bag like the methods described above.

The film for production of the self-supporting bag may comprise a single long sheet of film forming the part constituting the-bottom or two long sheets of film forming the part constituting the bottom at the both end parts to the transverse direction of the long sheet of film forming the part constituting the trunk. The film comprising two long sheets of film forming the part constituting the bottom is preferable because two self-supporting bags can be cut out to the transverse direction and the self-supporting bag can be produced more efficiently.

In the preferred method of production of the self-supporting bag, the part constituting the trunk is put together with the part constituting the bottom one on top of the other with the heat adhesive plastic layer placed at the inner side in such a way that the film forming the part constituting the bottom described above forms an approximate W shape when the film forming the part constituting the bottom is folded to the longitudinal direction.

When the films are put together, it is not necessarily required that the part put together forms the approximate W shape at the time when the films are put together. It is only necessary that the part takes the approximate W shape when the part constituting the bottom is folded to the longitudinal direction. The part constituting the bottom may be attached without folding to the part constituting the trunk in the folded condition or the part constituting the trunk is attached to the part constituting the bottom in the folded condition.

When the long sheet of the film forming the part constituting the bottom is put together with the long sheet of the film forming the part constituting the trunk as described above, the two long sheets of the film constituting the trunk are put .together with the the long sheet of the film constituting the bottom by having the folded part to the longitudinal direction of the long sheet of the film forming the bottom at the middle of the two parts.

When the part constituting the bottom and the part constituting the trunk are made of separate films, these two parts are not necessarily put together by adhesion but they may be put together by adhesion. When the two parts are not put together by adhesion, they can be put together by heat sealing or the like in a later process.

In the preferred method of the production of the self-supporting bag, the process (3) in which the shape of the bag is formed from the multilayer plastic films put together in the process (2) is performed.

The heat sealing in the process (3) is performed to form the shape of the bag in such a way that the linear fibs are arranged on specified locations. Shape of the heat seal can be suitably selected according to the shape of the bag. It is preferred that the linear fibs are formed on the multilayer plastic film at locations designated in advance.

Shape of the side part of the self-supporting bag can be formed by forming the heat seal lines described above on the film after the part constituting the bottom of the multilayer plastic film is folded to the W shape.

Various shapes of the bottom can be made by heat sealing in various ways while the parts constituting the trunk are put together with the part constituting the bottom. The heat seal part having oblique inner side between the end part of the bottom and the folded line made by folding to the longitudinal direction of the part constituting the bottom or the heat seal part having the inner side curved to the shape of arc of the curvature of R80 or more between the lower ends of the heat seal parts having the oblique inner sides is formed in the process (3). These heat seal parts are formed so that the bottom takes an approximately hexagonal shape when the bag is in the condition of self-supporting.

The heat seal part having oblique inner side may be formed with or without folding of the part constituting the bottom.

In the preferred method of the production of the self-supporting bag, the process (4) in which the bag is cut out from the multilayer plastic film prepared in the process (3) is performed.

The process (4) is the same as the process (4) in the method of production of the self-supporting bag of the invention described above.

In the preferred method of production of the self-supporting bag of the invention, like the method of production of the self-supporting bag described above, it is preferred that the processes (1) , (2), (3) and (4) are performed continuously to produce the self-supporting bag continuously because the self-supporting bag can be produced efficiently.

The self-supporting bag of the invention is produced by cutting out the self-supporting bag having the heat seal lines described above from the multilayer plastic film. It is preferred that two self-supporting bags arranged to the transverse direction of the long sheet of the multilayer plastic film forming the part constituting the trunk are cut out simultaneously. When the film for production of the self-supporting bag in which the both end parts to the transverse direction of the long sheet of the plastic film made by putting two sheets together corresponds to the parts constituting the bottom of the two self-supporting bags is utilized, two self-supporting bags arranged in opposite directions can be cut out.

Height and width of the self-supporting bag are not particularly limited and various sizes can selected according to the required properties. The self-supporting bag of the invention has the excellent self-supporting property and the excellent property of holding the shape even when the size of the bag is considerably large.

When the self-supporting bag is produced by utilizing laminates of plastic films having different melting points, the heat seal necessary for the preparation of the bag can be made by a single process and the bag can be produced efficiently.

The apparatus for production of the self-supporting bag having linear ribs to practice the method of the production of the invention is described in the following.

The apparatus of production of a self-supporting bag having linear ribs comprises means (1) of producing a multilayer plastic film having linear ribs comprising a means of positive molding which comprises a positive mold having linear protrusions at the top face, a means of supplying a material which supplies a multilayer plastic film comprising a heat adhesive plastic layer as the surface layer to the means of positive molding and a means of fixing raised parts on the multilayer plastic film which are formed by pressing the linear protrusions of the positive mold to the multilayer plastic film; means (2) of putting together two or more of the multilayer plastic film having linear ribs or the multilayer plastic film having linear ribs and another multilayer film in such a way that the heat adhesive plastic layers are placed between the layers; means (3) of heat sealing the multilayer plastic films thus put together to form the shape of the bag and means (4) of cutting out the bag from the heat sealed multilayer plastic film.

The means (1) of producing a multilayer plastic film having linear ribs comprises a means of positive molding which comprises a positive mold having linear protrusions at the top face, a means of supplying a material which supplies a multilayer plastic film comprising a heat adhesive plastic layer as the surface layer to the means of positive molding and a means of fixing raised parts on the multilayer plastic film which are formed by pressing the linear protrusions of the positive mold to the multilayer plastic film.

These means have the same function as the functions described in the process (1) of the method of production of self-supporting bag having linear ribs of the invention. Other functions than those described above are described in the following.

The means of positive molding comprising a positive mold having a linear protrusion at the top face can be driven by various kinds of driving method. Examples of the driving method are the method of pressing against and removing from the plastic film by moving the positive mold vertically back and forth, the method of pressing linear protrusions formed on the surface of a roll against the plastic film by rotating the roll and the like.

It is preferred that linear ribs are formed in two sheets of the multilayer plastic film simultaneously by utilizing a positive mold of a plate shape having linear protrusions on the both faces, pressing two sheets of the multilayer plastic film against the both faces of the mold simultaneously and pressing a pressing plate having a fiat surface downward against the upper multilayer plastic film on the mold. When the bag is produced by putting together two sheets of the the multilayer plastic film on which linear ribs are formed by this method, the linear ribs can be arranged on the opposite parts constituting the trunk of the self-supporting bag simultaneously and the formation of the linear ribs on the multilayer plastic film and the formation of the shape of the self-supporting bag can be performed efficiently.

The means of fixing the raised part can be driven by various kinds of driving methods. Examples of the driving method are the method of pressing against and removing from the multilayer plastic film with a cooling mold by moving the cooling mold vertically back and forth, the method of pressing the multilayer plastic film with a cooling roll by rotating the roll and the like.

The means of positive molding comprising a positive mold having linear protrusions at the top face and the means of fixing the raised part may be fixed together or arranged separately. When the means of positive molding comprising a positive mold having linear protrusions at the top face and the means of fixing the raised part are arranged separately, the multilayer plastic film can be transferred between them by various methods, such as the method of transfer by clipping the multilayer plastic film with clamps and moving the clamps intermittently.

In the means (1) of the invention, a winding means which winds the multilayer plastic film produced in the process may be comprised. The winding means can wind the multilayer plastic film continuously or intermittently.

The apparatus of production of the self-supporting bag having linear ribs comprises means (2) of putting together two or more of the multilayer plastic film having linear ribs or the multilayer plastic film having linear ribs and another multilayer film by laying one on top of the other in such a way that the heat adhesive plastic layers are placed between the layers.

As the means of putting together the multilayer plastic films, the method of putting together by guiding the multilayer plastic films with rolls, the method of putting together by guiding the multilayer plastic films by guides or other various kinds of method can be adopted.

The apparatus of production of the self-supporting bag having linear ribs comprises means (3) of heat sealing the multilayer plastic films thus put together to form the shape of the bag.

The heat seal can be made by driving various kinds of means of melt sealing, such as the means of melt sealing with a heat seal bar, the means of melt sealing with vibration of ultrasonic wave, the means of melt sealing by heating with an adhesive and the like with a driving apparatus as described above.

The driving of the means of melt sealing can be made by various methods, such as the method of pressing against and removing from the multilayer plastic film a means of heating which moves vertically back and forth, the method of heat sealing the multilayer plastic film with a heating means attached on the surface of a roll by rotating the roll and the like.

The apparatus of production of the self-supporting bag having linear ribs comprises means (4) of cutting out a bag from the heat sealed multilayer plastic film.

The cutting out can be performed by driving cutting blades or melt cutting blades with a driving apparatus. The cutting blades can be attached, for example, to a driving apparatus moving vertically or on the surface of a rotating roll.

Example

The invention is described in more detail with reference to the attached drawings of the examples in the following.

However, these examples are intended to illustrate the invention and are not to be construed to limit the scope of the invention.

FIG. 1 is a chart showing the outline of the apparatus of production of the multilayer plastic film having linear ribs utilized in the process (1) of the invention.

In FIG. 1, a long sheet of a multilayer plastic film 2 (composition: a two layer film comprising a polyethylene film of 140 μm thickness and a stretched nylon 6—6 film of 15 μm thickness; thickness and width of the two layer film: 160 μm and 550 mm, respectively) is supplied from a material sheet roll 1 of the multilayer plastic film to a positive mold 4 through a dancer roll 3. In the part of the positive mold, the multilayer plastic film 2 is laid on the top of a receiving table 18 made of a fiat metal plate (a fiat plate mold) in such a way that the layer of the stretched nylon 6—6 film is on the lower side. The positive roll on which, in a similar way to the arrangement shown in FIG. 4, linear protrusions having parts curved to the shape of an approximate arc of a width of 600 μm, length of 30 mm and curvature of R15 are arranged at a distance of 30 mm is pressed against the multilayer plastic film 2 with downward movement by a positive mold driver 5 which can move the positive mold 4 vertically. The linear protrusions having parts curved to the shape of an approximate arc at the top face of the positive mold 4 is heated to 120° C. In a particular example, the linear protrusions are pressed against the multilayer plastic film until the the depth of the trough on the plastic film and the thickness of the film at the bottom of the trough became 130 μm and 30 μm respectively and then kept in this condition for 1 second.

Then, a holder 8 is moved downward by a holder driver 9 which can move the holder 8 vertically to hold the multilayer plastic film 2 intermittently. The positive mold 4 is moved upward by the positive mold driver 5 to separate the positive mold 4 from the film. When the positive mold 4 is moved upward, the multilayer plastic film 2 is held down by the holder 8 and a cooling mold 6 so that the multilayer plastic film 2 is not pulled up with the positive mold. By this process, linear troughs having width of 600 μm and depth of 130 μm and raised parts having height of 80 μm at the both sides of the upper edges of the troughs can be formed on the multilayer film in this particular example.

The holder 8 and the cooling mold 6 are then pulled up and the multilayer plastic film 2 is held with pairs of clamps 10, 12 and 13, 15 by moving the clamps 10 and 13 downward with clamp drivers 11 and 14. The clamps are transferred to a cooling apparatus of the next stage by moving them with a clamp pitch mover 17 along a clamp axis 16 by one pitch to the horizontal direction. The clamps return to the original positions after the multilayer plastic film 2 is moved by one pitch.

In the cooling apparatus, the cooling mold 6 is moved downward by the cooling mold driver 7 which can move the cooling mold 6 vertically to make approach to the multilayer plastic film 2. The cooling mold 6 blows air stream of 25° C. to the surface of the multilayer plastic film 2 for 1.5 seconds. Then, the cooling mold 6 is pulled upward and the multilayer plastic film having linear ribs 2 is winded into a winding roll 20. After the cooling mold 6 starts blowing the air, the positive mold 4 is moved downward to press the multilayer plastic film 2. The procedures described above are repeated and the plastic film having the linear troughs and the linear ribs can be produced continuously.

Tension of the multilayer plastic film 2 can be adjusted by the dancer rolls.

Thus, ribs are formed on the multilayer plastic film in such a way that the troughs are formed on the polyethylene film layer alone.

Figure 2:
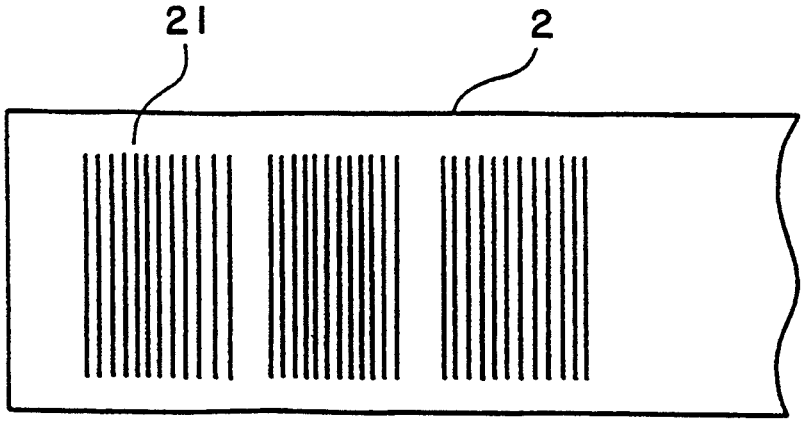
FIG. 2 is a plan view showing an example of the multilayer plastic film having linear ribs produced by the process (1) of the invention.

In FIG. 2, parallel ribs are formed on one side of the multilayer plastic film 2.

Figure 3:
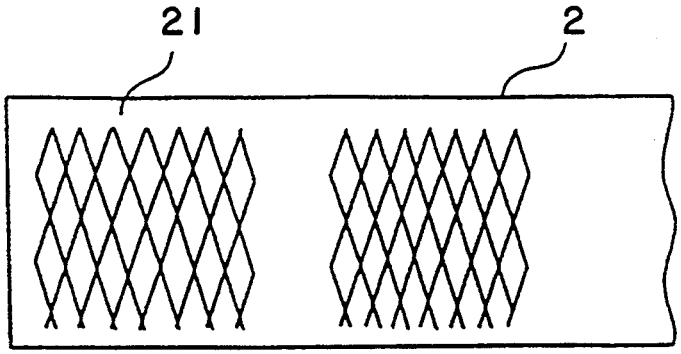
FIG. 3 is a plan view showing another example of the multilayer plastic film having linear ribs produced by the process (1) of the invention.

In FIG. 3, another example of the shape of the linear ribs formed on the multilayer plastic film 2 is shown. The linear ribs form rhombic shape.

Figure 4:
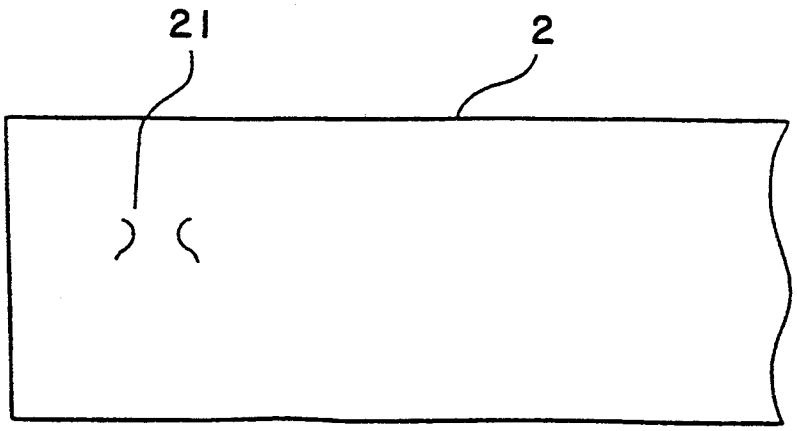
FIG. 4 is a plan view showing still another example of the multilayer plastic film having linear ribs produced by the process (1) of the invention.

In FIG. 4, linear ribs having parts curved to the shape of an approximate arc 21 are formed on one side of the multilayer plastic film 2.

Figure 5:
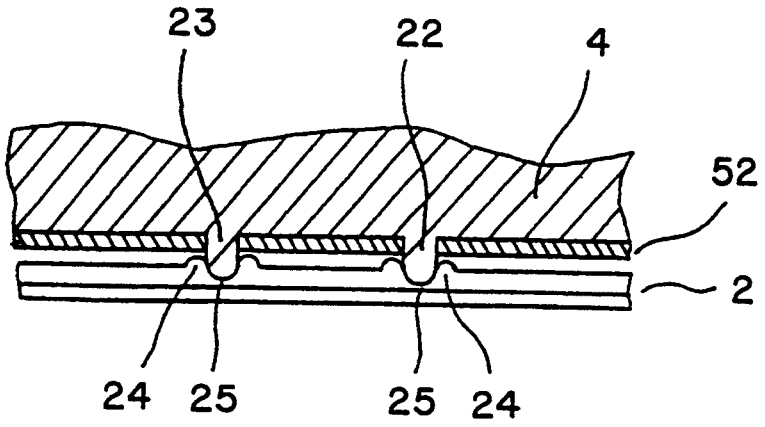
FIG. 5 is a section view showing the condition of the multilayer plastic film pressed by a positive mold having linear protrusions as an example of the process (1) of the invention.

FIG. 5 is a magnified section view showing the formation of the linear troughs 25 and the raised parts 24 by pressing of the linear protrusions 22 and 23 at the top face of the positive mold 4 against the multilayer plastic film 2. The surface of the positive mold 4 excluding the area of the linear protrusions 22 and 23 is covered with a heat insulating material 52 so that heat is transferred easily from the protrusions 22 and 23 to the multilayer plastic film 2 but with difficulty from other parts of the surface. The linear ribs are formed efficiently by this method.

Figure 6:
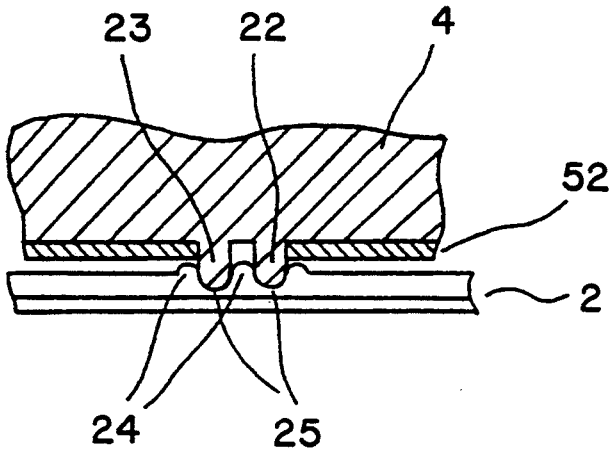
FIG. 6 is a magnified section view showing the condition of the multilayer plastic film pressed by a positive mold having linear protrusions as another example of the process (1) of the invention.

FIG. 6 is a magnified section view showing formation of the troughs 25 and the raised parts 24 when the distance between the two linear protrusions 22 and 23 shown in FIG. 5 are made shorter. Width of the linear protrusions 22 and 23 are 500 μm respectively and the distance between them is 2 mm. Because of this change the number of the raised part 24 is reduced to 3.

Figure 7:
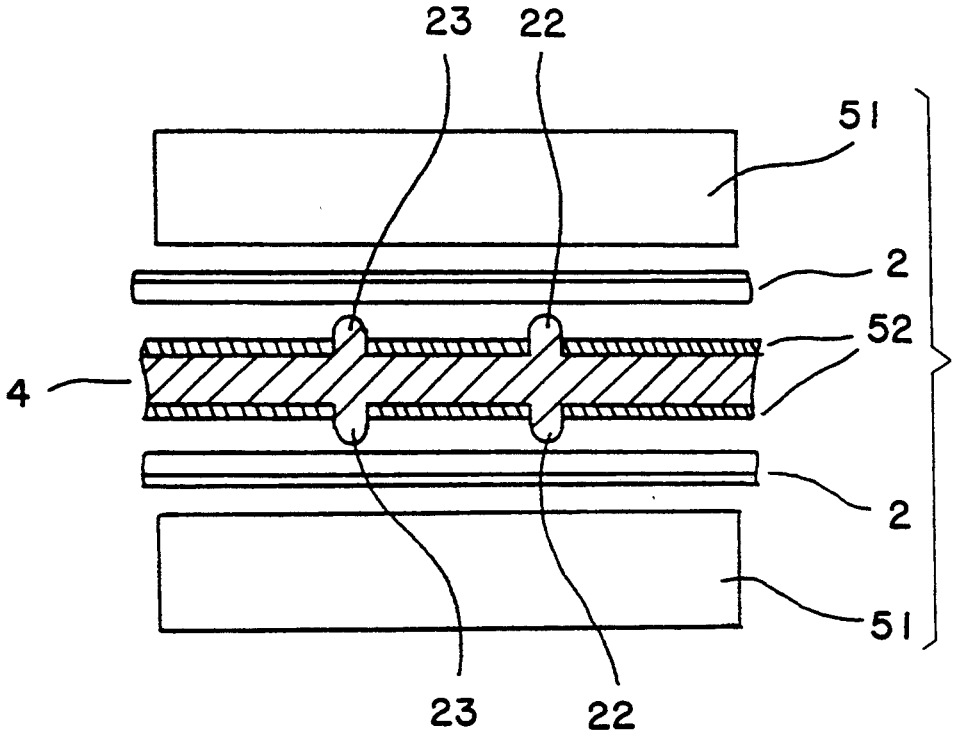
FIG. 7 is a section view showing another example of the positive mold utilized in the apparatus of FIG. 1.

FIG. 7 shows another example of the shape of the positive mold 4 which forms ribs on the self-supporting bag of the invention in the apparatus for formation of linear ribs shown in FIG. 1.

This positive mold 4 has a plate shape, having the linear protrusions 22 and 23 at the both sides thereof. The positive mold takes a fixed position in the apparatus and sheets of the multilayer plastic film are pressed against the both sides of the mold. The pressing plates 51 which can move vertically are pressed against the sheets of the multilayer plastic film. By this method, linear ribs can be formed on two sheets of the multilayer plastic film simultaneously.

Figure 8:
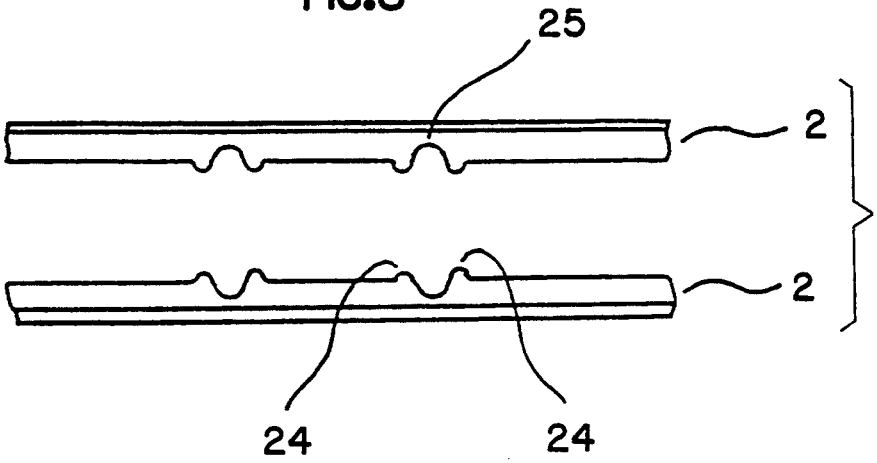
FIG. 8 is a section view of the multilayer plastic film having linear ribs formed by using the positive mold of FIG. 7.

FIG. 8 is a section view of the multilayer plastic film having linear ribs formed by the positive mold 4 of FIG. 7.

Figure 9:
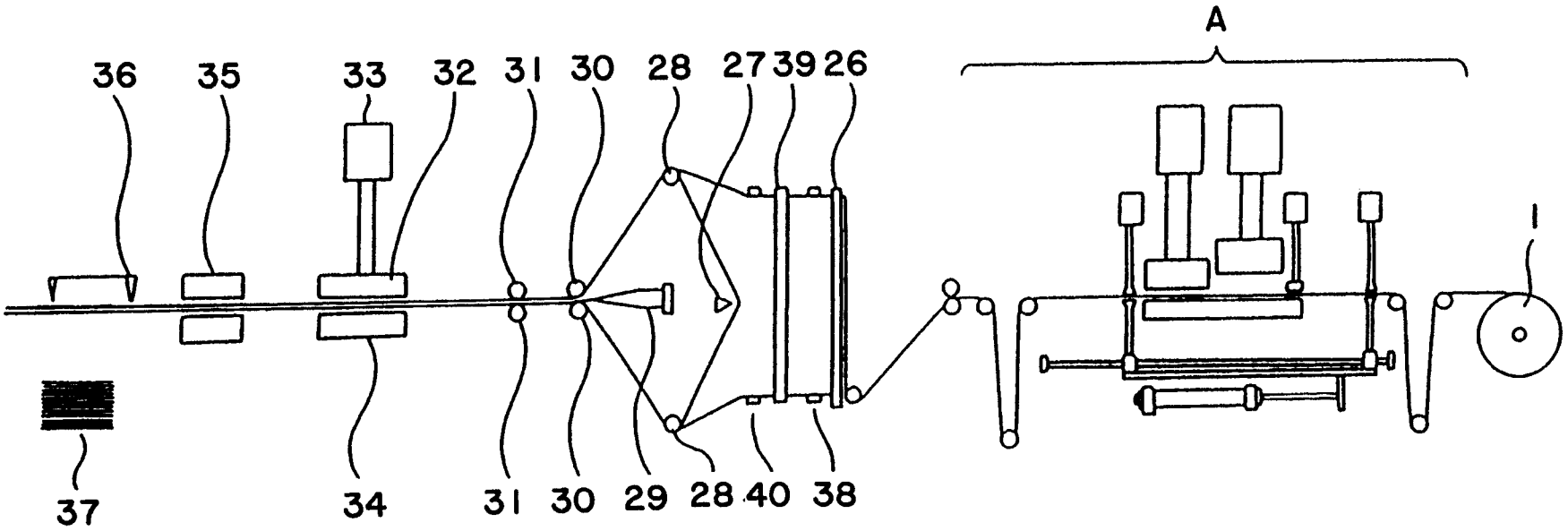
FIG. 9 is a diagram showing the outline of the apparatus of production of the self-supporting bag having linear ribs of the invention.

FIG. 9 is a chart showing outline of the apparatus of production of self-supporting bag of the invention. The plastic film pulled out from the material sheet roll in the figure is the multilayer plastic film utilized in FIG. 1. The linear ribs are formed on the plastic film by the apparatus of formation of linear troughs and linear ribs (part A) shown in FIG. 1.

The multilayer plastic film having linear ribs is then rotated by 90 degree with a guide for change of direction 26 and cut along the central line to the longitudinal direction by a cutter 27 to form two sheets of the multilayer plastic film having linear ribs. The two sheets of the multilayer plastic film having linear ribs thus formed are further rotated by 90 degree with rolls 28 and put together by rolls 30 in such a way that the faces having the linear ribs are placed inward. At the same time, the multilayer plastic film forming the part constituting the bottom (the same film as the multilayer plastic film shown in FIG. 1) 29 is folded into a half and inserted between the sheets of the multilayer plastic film having linear ribs put together in the above at the both end parts thereof. By this process, the end parts of the sheet comprise four sheets of the multilayer plastic film put together. The multilayer plastic film forming the part constituting the bottom is supplied from the material sheet roll placed at the side perpendicular to the plane of the drawing though it is not shown in FIG. 9.

The multilayer plastic film put together is laid on the receiving table for heat seal 34 and the side part and the bottom part of the bag are heat sealed by the heat seal bar 32 to form the shape a bag.

The heat sealed multilayer plastic film is then cooled by a cooling mold 35 and cut to the shape of the bag by a cutting blade 37 to produce the bag 37. The remaining sheet of the multilayer plastic film after cutting out of the bag 37 is winded by a winding roll which is not shown in the figure.

In the method of FIG. 9, the cutter 27 may be placed before the apparatus of formation of the linear ribs (A) to prepare two sheets of the multilayer plastic film there and the linear ribs may be formed on the separated two sheets of the multilayer plastic film by pressing them with the positive mold of FIG. 7.

Figure 10:
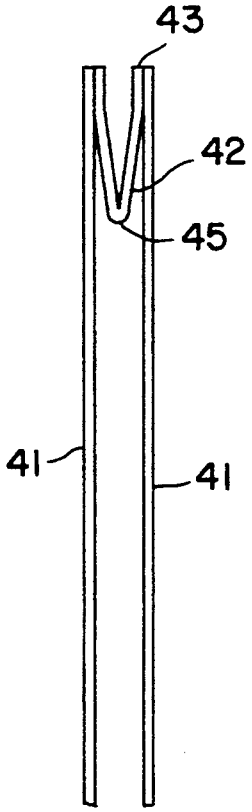
FIG. 10 is a section view of a film for production of the self-supporting bag of an example of the invention. The part constituting the trunk is formed by putting together two long sheets of the multilayer plastic film and the part constituting the bottom made of the long sheet of the multilayer plastic film is attached at the both ends to the transverse direction of the part constituting the trunk thus formed.

In FIG. 10, parts constituting the trunk 41 made of two long sheets of the multilayer plastic film having linear ribs which have the same width (composition: a multilayer film comprising polypropylene film having thickness of 100 μm and stretched nylon 6—6 film having thickness of 15 μm; thickness of the multilayer film: 120 μm) are put together. The both end parts to the transverse direction of this combined sheet are opened and the part constituting the bottom 42 made of a long sheet of the multilayer plastic film (composition: the same as the multilayer plastic film of the part constituting the trunk; thickness: 120 μm) is inserted to the open end parts of the part constituting the trunk and attached to them at heat seal lines 43 having width of 5 mm by heat sealing at 180° C. with a heat seal bar in such a way that the polypropylene layer is utilized as the heat sealing face. The heat seal lines are located in the peripheral part of the bottom part of the bag when the bag is self-supporting and the stiffness of the bag can be enhanced by the heat seal lines.

Figure 11:
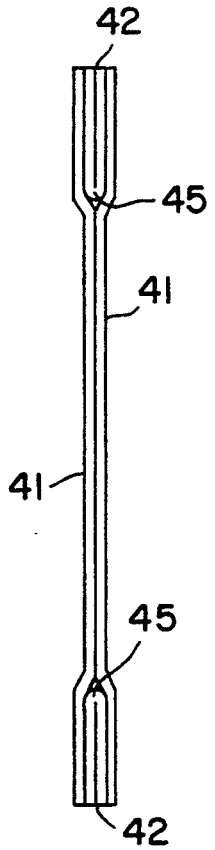
FIG. 11 is a section view of a film for production of the self-supporting bag of an example of the invention. A multilayer plastic film is folded to a W shape to form the part constituting the bottom and put together with two sheets of a long multilayer plastic film constituting the trunk.

In FIG. 11, the film for production of the self-supporting bag comprising parts constituting the trunk 41 is attached with the parts constituting the bottom 42 before the heat sealing and the parts constituting the bottom 42 therein is folded at the folding part 45 and inserted between the end parts of the parts constituting the trunk. The two sheets of the part constituting the trunk 41 are put together with complete fitting and the whole thing takes a fiat shape.

Figure 12:
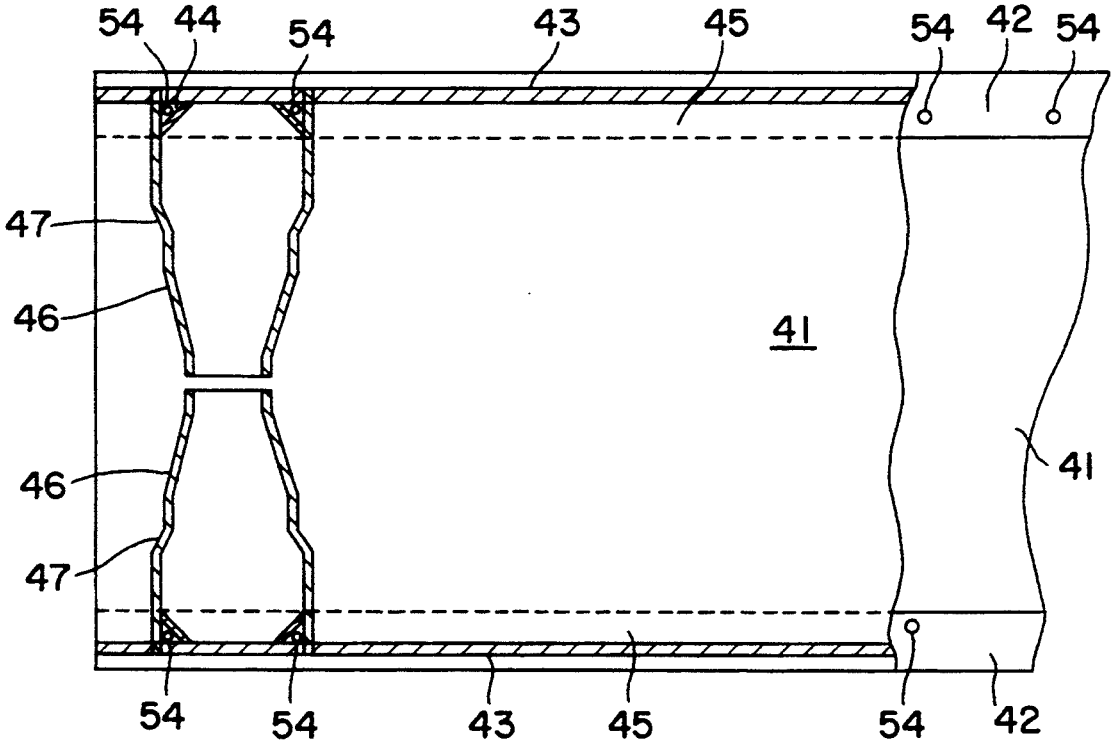
FIG. 12 is a plan view of a film for production of the self-supporting bag of an example of the invention. Two sheets of the parts constituting the trunk put together are heat sealed at the heat seal parts shown in FIG. 6 to form two self-supporting bags in the transverse direction.

In FIG. 12, a heat seal bar of 180° C. which can be moved vertically is pressed against the part constituting the trunk 41 of the fiat shape to form the side seal lines 46 which constitute the side parts of the self-supporting bag. The part constituting the trunk made from multiple sheets in the above can be easily melt sealed by the heat seal bar of 180° C. because the layer of polypropylene having lower melting point is laid at the inner side. The side seal lines 46 have a width of 5 mm. The self-supporting bag has a constriction part at the middle part of the bag in the vertical direction and, above the constriction part, the width of the bag is continuously decreased toward the top of the bag. In the part folded to a W shape in the part constituting the bottom, parts in which polypropylene films are faced .with each other can be heat sealed to form the side seal lines 46. However, layers of the stretched nylon 6—6 film having the higher melting temperature are face with each other at the innermost part and this part cannot be heat sealed by the heat seal bar of 180° C. For solving this problem, a number of small holes 54 are made at the positions of side seal lines 46 in the part constituting the bottom 42 before the heat sealing. The sheets in these parts are heat sealed with the melt polypropylene which melts and moves to the interface of the sheets of the stretched nylon 6—6 through the holes by the heat pressing with the heat seal bar. The heat seal lines in the area where the layers of the stretched nylon 6—6 are faced with each other are not necessarily sealed continuously.

In FIG. 12, heat seal lines 43 and heat seal lines 44 are simultaneously formed when the side seal lines 46 are formed. These lines may be formed separately. When the heat seal lines 43 and the heat seal lines 44 are formed separately, the heat sealing can be made by pressing the heat seal bar on the multilayer plastic film.

When these heat seal lines are formed simultaneously, the part where the layers of the polypropylene having the lower melting temperature are faced with each other can be heat sealed easily but the part where the layers of the stretched nylon 6—6 having the higher melting point are face with each other is not heat sealed. Thus, the heat seal lines 43 and 44 and the side seal lines 46 can be formed efficiently.

Length between the folded part 45 and the end part of the bottom can be suitably selected according to the required properties of the self-supporting bag. It is preferably in the range from 10 to 40% of the width of the self-supporting bag.

At the top end of the self-supporting bag, an opening is formed. With the opening is about 50% of the width of the folded part of the bottom. From the plastic film 41 on which the side seal lines 46 are formed, the self-supporting bag can be produced by punching out with a punching blade along the outside of the side seal lines 46. The formation of the side seal line and the punching out of the bag may be performed simultaneously.

The remaining part of the long sheet of the multilayer plastic film after the self-supporting bag is punched out is wound by a winding roll which is not shown in the figure.

Figure 13:
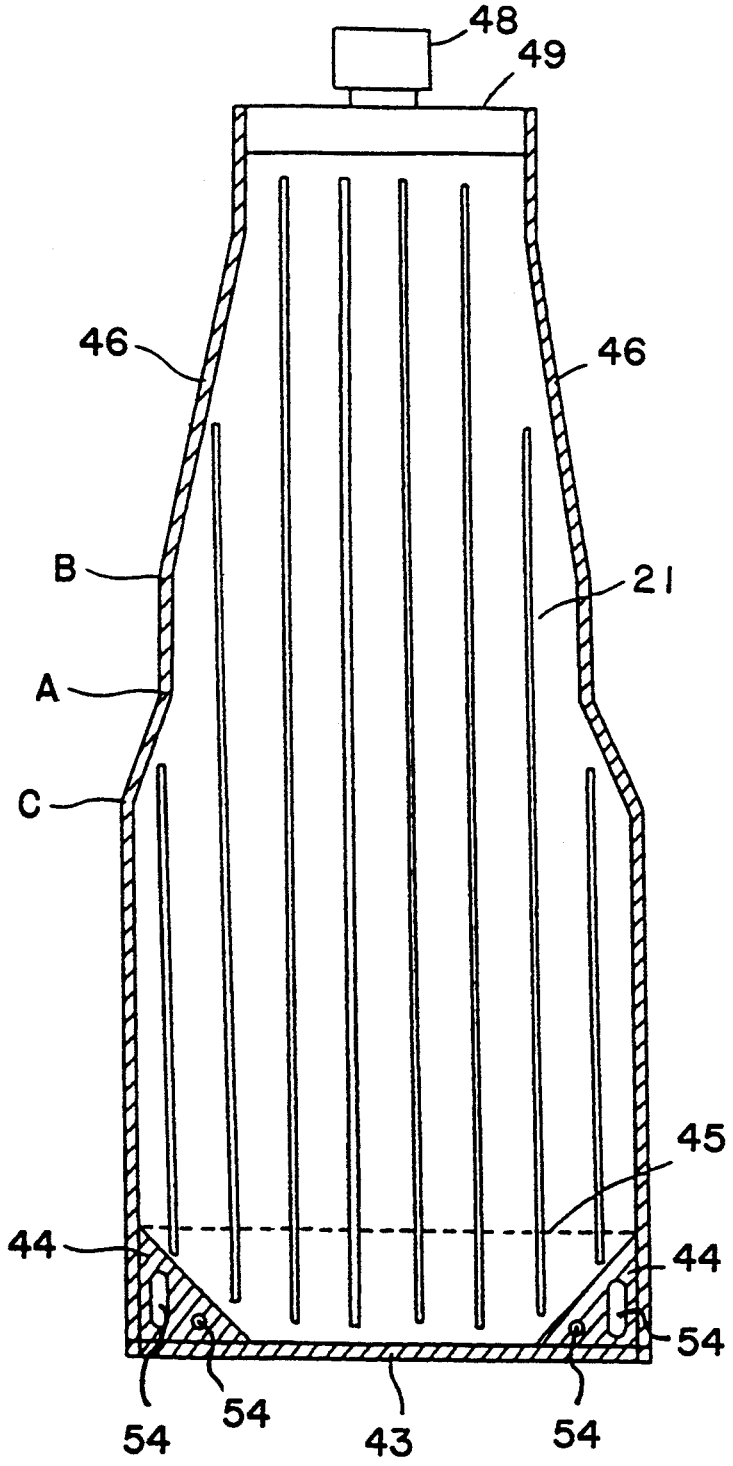
FIG. 13 is a plan view of the self-supporting bag of an example of the invention.

FIG. 13 is a plan view of an example of the self-supporting bag of the invention.

FIG. 13 shows a self-supporting bag made by attaching a stopper with a cap to the self-supporting bag of the invention punched out by the apparatus of production of the self-supporting bag shown in FIG. 9. In the side seal lines 46 at the side parts of the self-supporting bag, a constriction part is formed in the area between the point B and the point C at the middle part of the each side seal line. In the parts of the oblique heat seal lines 44, the areas inside of the the oblique heat seal lines 44 and the heat seal lines at the bottom 43 are heat sealed except the areas of ellipses and circles and the stiffness of the bottom part is further enhanced by this structure.

In this particular example, the self-supporting bag has a height of 260 mm, a width of 140 mm at the folded part 5 of the self-supporting bag, a width of the opening at the top of the self-supporting bag of 80 mm and a length between the folded part 5 and the end part of the bottom of 40 mm.

Figure 14:
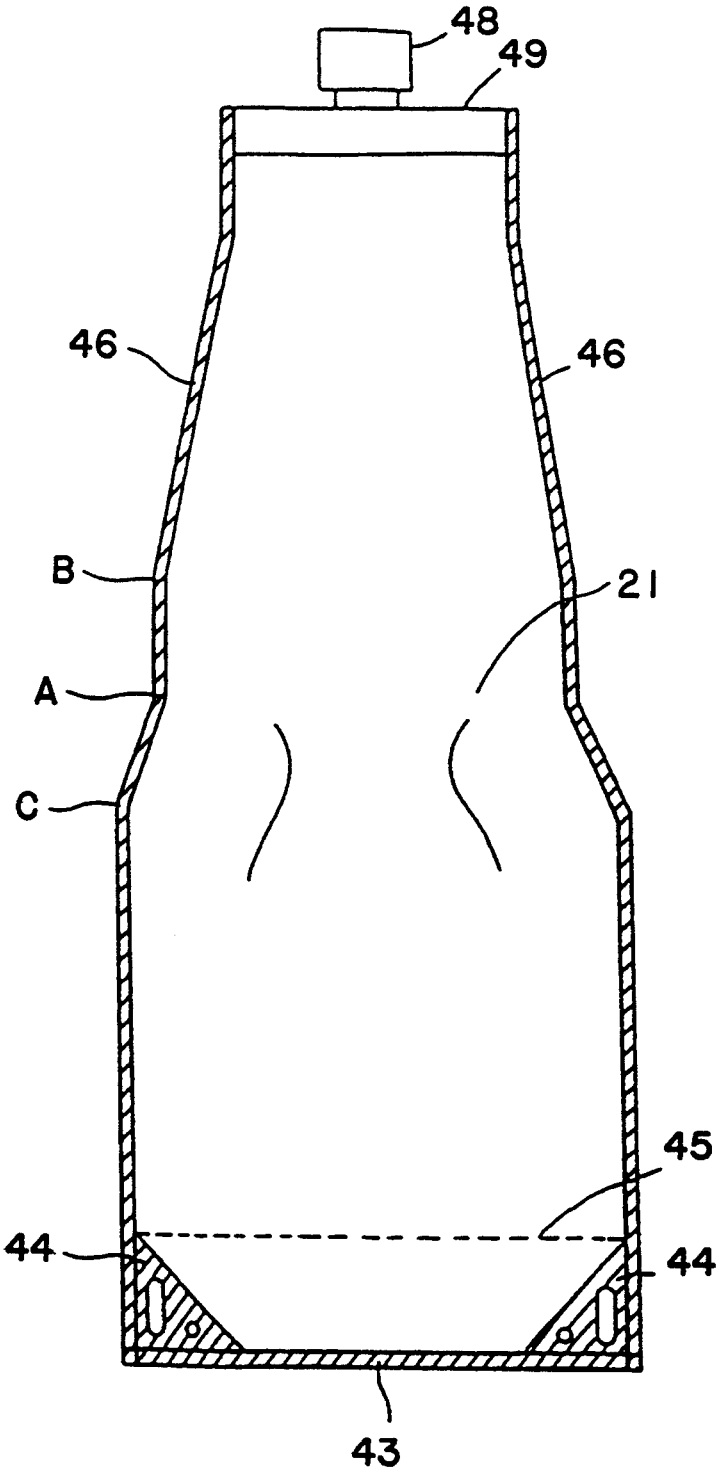
FIG. 14 is a plan view of the self-supporting bag of an example of the invention.

FIG. 14 shows a self-supporting bag made by attaching a stopper with a cap to the self-supporting bag of the invention punched out by the apparatus of production of the self-supporting bag shown in FIG. 9. In the side seal lines 46 at the side parts of the self-supporting bag, a constriction part is formed in the area between the point B and the point C at the middle part of the each side seal line.

This self-supporting bag has a pair of linear ribs 21 having a part curved to the shape of an approximate arc and convex to the inward direction at the symmetrical positions on both sides at positions lower than the constriction part A by 10% of the height of the bag and separated from the side seal lines 46 to the inward direction by 30% of the width of the bag. These linear ribs 21 has the part curved to the shape of an approximate arc of the curvature of R15 and convex to the inward direction. Length of the part curved to the shape of an approximate arc is 30 cm. The upper end parts of the linear ribs 21 have the shape of arc of the curvature of R100 and the ends are at positions separated from the top of the bag by 15% and from the side seal lines to the inward direction by 5% of the width of the bag. This pair of the linear ribs are formed on the both parts constituting the trunk. Because the linear ribs 21 are easily folded, the linear troughs are folded to form the end part of the concave part formed by the constriction part when the self-supporting bag is charged with the content. Thus, the formation of the concave part by the constriction part can be assured and the very excellent self-supporting property can be realized. Furthermore, the concave part can be formed at a specified position with a specified shape and the very excellent property of holding shape can also be realized.

In the part of the oblique heat seal line 44, the area inside of the the oblique heat seal line 44 and the heat seal line at the bottom 43 is heat sealed except the areas of an ellipse and a circle and the stiffness of the bottom part is further enhanced.

In this particular example, the self-supporting bag has a height of 260 mm, a width of 140 mm at the folded part 45 of the self-supporting bag, a width of the opening at the top of the self-supporting bag of 80 mm and a length between the folded part 45 and the end part of the bottom of 40 mm.

When the bag is charged with a content, the bag shows excellent property of self-supporting and remains standing when the lower parts of the bag is pushed with fingers from the both sides. The bag resumes the original shape when the fingers are removed, showing that the bag has the excellent property of resuming the original shape and the excellent property of holding the shape.

Figure 15:
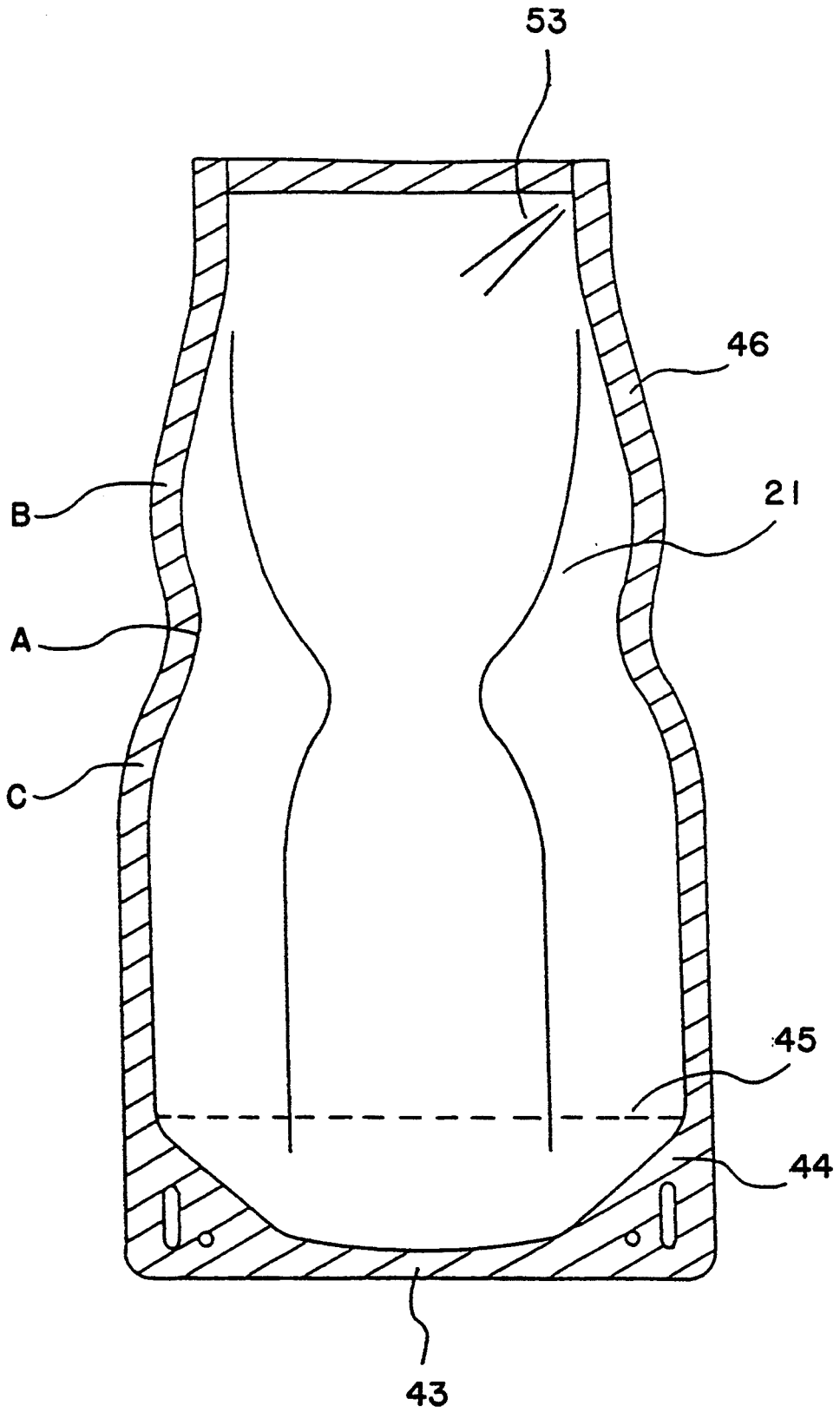
FIG. 15 is a plan view of the self-supporting bag of an example of the invention.
Figure 16:
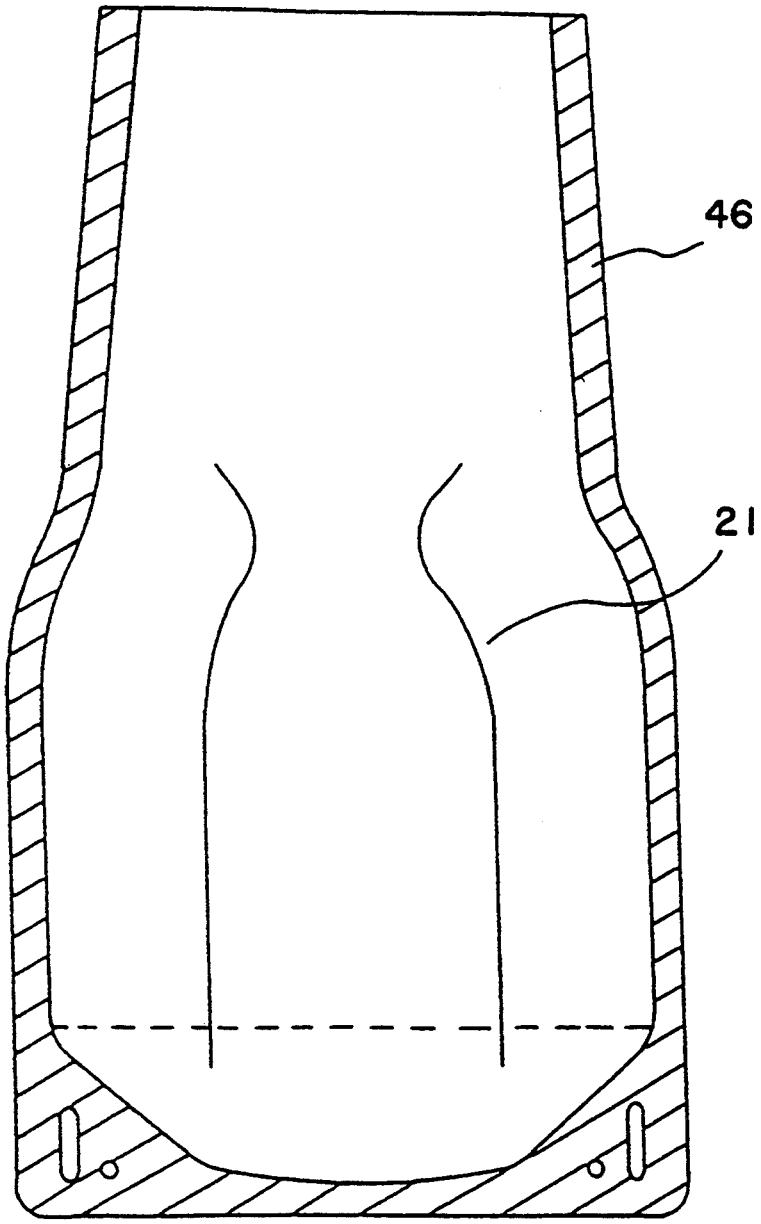
FIG. 16 is a plan view of the self-supporting bag of an example of the invention.
Figure 17:
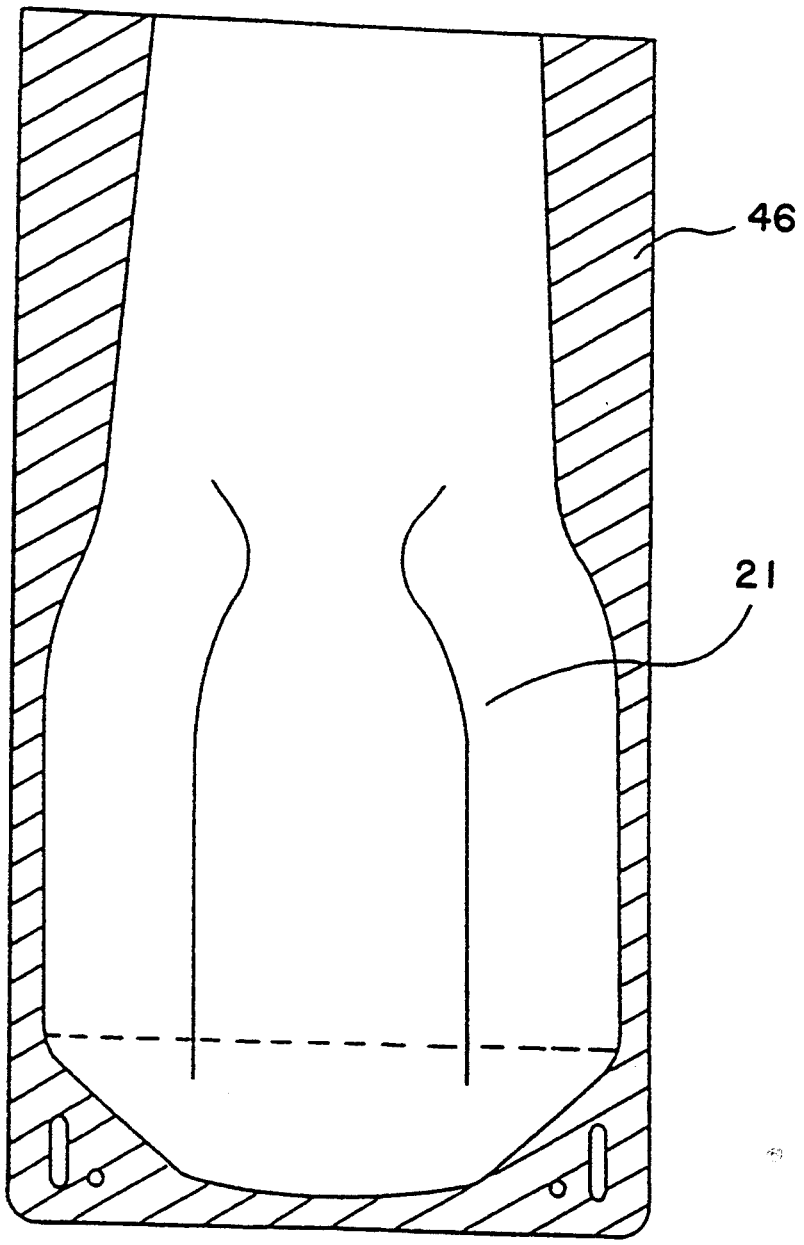
FIG. 17 is a plan view of the self-supporting bag of an example of the invention.

FIGS. 15, 16 and 17 are plan views showing other shapes of the self-supporting bag of the invention.

FIG. 15 shows a bag in which the upper ends and the lower ends of the linear ribs are extended. The upper ends of the ribs are extended to the height of about 85% of the height of the bag. The lower ends of the bag are extended along the side seal lines 46 to the positions at the inside of the side seal lines 46 by about 25% of the width of the bag. Surfaces can be formed by the linear ribs 21 and the self-supporting bag having very excellent self-supporting property can be produced.

At the lower end of the bottom part of the self-supporting bag, the heat seal parts having a inner side of an oblique line 44 are formed at the both sides of the bottom part of the bag. In the area between the two lower ends of the heat seal parts having the inner side of the oblique line 44, a heat seal part having the inner side curved to the shape of an arc of R150 43 is formed. The heat seal part 43 having the inner side curved to the shape of an arc is an reinforcing part forming the periphery of the bottom part of the bag. Because the inner end of this heat seal part is curved to the shape of an arc, the reinforcing part is not deformed to the inside and thus the bag has the very excellent self-supporting property.

In FIG. 15, linear ribs 53 for guiding the content are formed on the inner surface of the part constituting the trunk at the upper part of the self-supporting bag. The linear ribs 53 have a similar shape to that of the linear ribs 21. When the linear ribs are formed on the inner surface of the part constituting the trunk, the ribs work as the passage to the content and the content of the bag can be easily discharged through this passage.

In FIG. 16, side seal lines 46 have a shape of straight line in the area above the constriction part. The linear ribs 21 have the lower ends extended like the one in FIG. 15 but the upper ends of the ribs are not extended.

In FIG. 17, outside ends of the side seal lines 46 are formed so that the width of the upper part of the self-supporting bag has the same as that of the bottom part of the bag. This shape has the advantage that, when the self-supporting bag is punched out from the multilayer plastic film, removing the scrap pieces is not necessary. The self-supporting property of the bag can be satisfactorily retained even when additional parts remain at the outside of the side seal lines.

Figure 18:
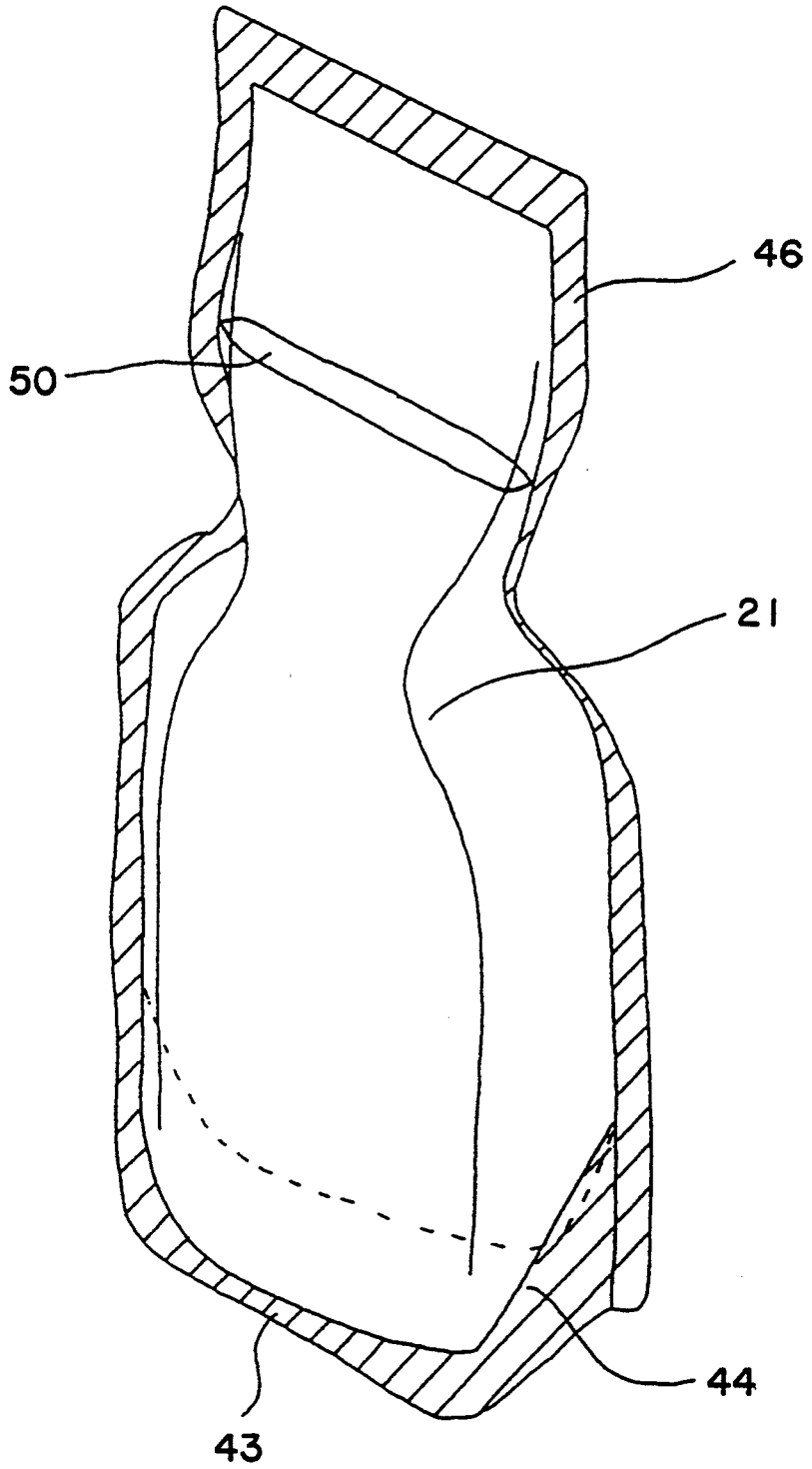
FIG. 18 is a perspective view of the self-supporting bag of an example of the invention shown in FIG. 18 in which a liquid content is charged.
Figure 19:
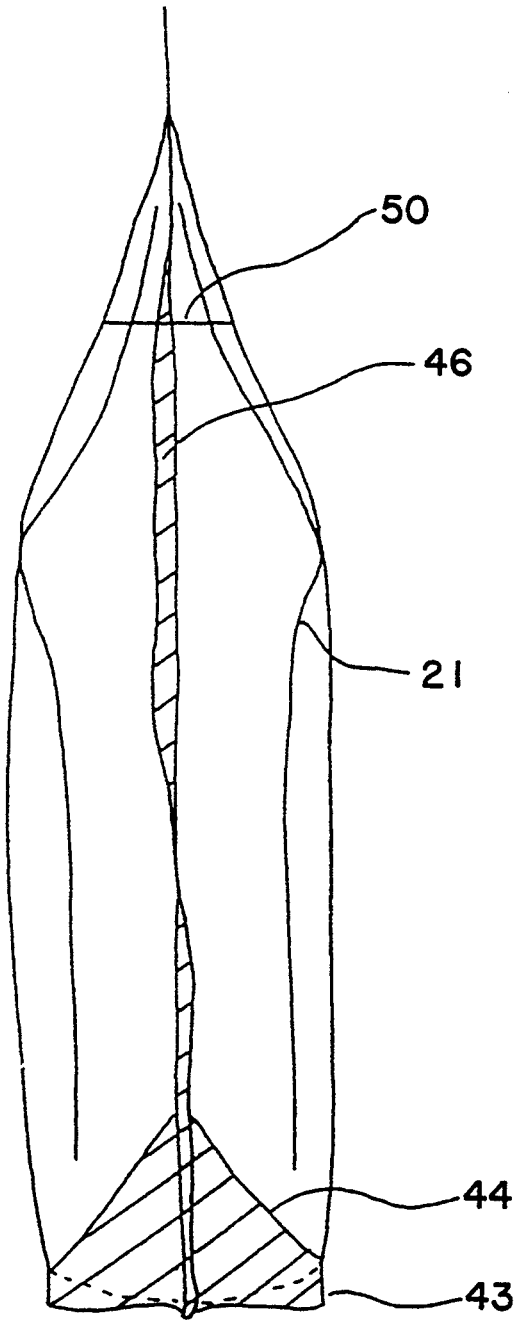
FIG. 19 is a side view of the self-supporting bag shown in FIG. 18.

FIG. 18 is a perspective view of the self-supporting bag shown in FIG. 15 when it is charged with a liquid content. FIG. 19 is a side view of the self-supporting bag shown in FIG. 15 when it is charged with the liquid content.

Figure 20:
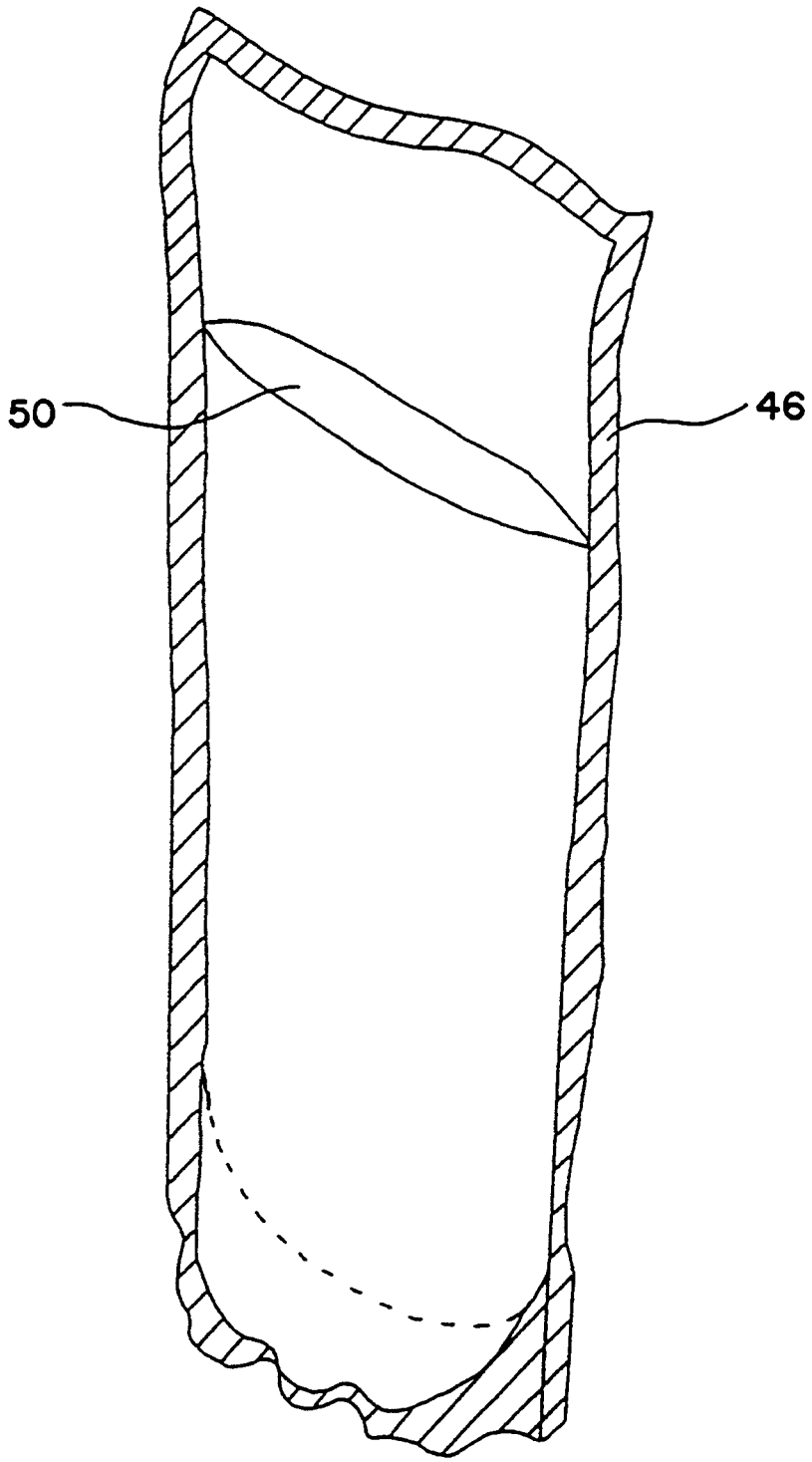
FIG. 20 is a perspective view of a doipack which is a conventional self-supporting bag and charged with a liquid content.

FIG. 20 shows a doipack which is one of conventional self-supporting bags. In the bottom part, heat seal parts curved to the shape of an arc of R65 at the inner sides are formed. The reinforced part at the bottom is deformed to a concave shape and the bag is inferior in the self-supporting property.

According to the invention, the self-supporting bag having the excellent self-supporting property and the excellent property of holding shape and easy for handling can be provided.

According to the invention, the linear ribs can be formed easily and efficiently on the multilayer plastic film, the stiffness of the multilayer plastic film can be enhanced and furthermore the self-supporting bag having linear ribs and high stiffness can be produced easily and efficiently from the multilayer plastic film having linear fibs.

Industrial Application

The invention is related to the self-supporting bag having the excellent stability in the self-supporting condition and the excellent property of holding shape and easy for handling.

What is claimed is:

1. A self-supporting bag having a trunk part and a bottom part, at least the trunk part having a trunk wall made of multilayered plastic film, the self-supporting bag comprising:

an inner layer of a heat adherable plastic material being laminated with an outer layer of a different material to form the multilayered plastic film of the trunk wall;

the trunk wall having convex and concave portions and having linear ribs formed in a surface thereof to stiffen the bag.

2. A self-supporting bag as claimed in claim 1, wherein the trunk part of the self-supporting bag is formed by a pair of the multilayered plastic films adhered to one another along side seal lines.

3. A self-supporting bag as claimed in claim 2 wherein the side seal lines converge so that the bag has an upper portion of a width which is narrower than the width of the folded part constituting the bottom part of the bag.

4. A self-supporting bag of claim 3, wherein the ribs and grooves are formed in the heat adherable plastic material.

5. The self-supporting bag of claim 3, wherein the outer layer of the multilayered plastic film has a melting point higher than that of the inner layer.

6. A self-supporting bag as claimed in claim 2 wherein the side seal lines converge toward one another proximate the middle of the trunk to form a constricted part.

7. A self-supporting bag as claimed in claim 6 wherein the linear ribs are configured as convex curves with respect to longitudinal center lines of the film forming the trunk wall at position located at about the same height as the constricted part the convex curve being separated from the side seal lines by about at least 10% of the width of the bag.

8. A self-supporting bag as claimed in claim 7 wherein the linear ribs have lower end portions which are extended to the vicinity of the bottom area of the bag.

9. A self-supporting bag as claimed in claim 6 wherein the bottom part has a fold therein which forms a folded part of a selected width which cooperates with the trunk part to form an approxiamte W shape.

10. A self-supporting bag as claimed in claim 9 wherein the side seal lines converge so that the bag has an upper portion of a width which is narrower than the width of a folded part constituting the bottom part of the bag.

11. A self-supporting bag as claimed in claim 10 wherein the linear ribs are configured as convex curves with respect to the longitudinal center lines of the films forming the trunk wall at positions located at about the same height as the constricted part, the convex curves being separated from the side seal lines by about at least 10% of the width of the bag.

12. A self-supporting bag as claimed in claim 11 wherein the linear ribs upper end portions which extend to the vicinity of the side seal lines at the top of the bag.

13. A self-supporting bag as claimed in claim 11 wherein the linear ribs have lower end portions which are extend to the vicinity of the bottom area of the bag along the side seal lines.

14. A self-supporting bag as claimed in claim 13 wherein the linear ribs have upper end portions which extended to the vicinity of the side seal lines at the top of the bag.

15. A self-supporting bag as claimed in claim 14 wherein the linear ribs are formed by pressing a positive mold having linear protrusions on a top face against the multilayer plastic film to form linear troughs in the film with a decrease in thickness of the film and with raised parts at the upper edges of the troughs forming the ribs on the film.

16. A self-supporting bag as claimed in claim 15 wherein additional linear ribs for guiding content are formed on the inner surface of the outlet of the bag.

17. A self-supporting bag as claimed in claim 1 wherein the bottom part is folded so that the trunk part and the bottom part form an approximate W shape, the bottom part having heat seal parts having oblique inner sides placed between the ends thereof so that the bottom part of the bag forms a generally hexagonal shape when in a self-supporting mode and heat seal parts having inner sides curved to a shape of an arc of at least an R80 curvature are formed in parts between lower ends of the heat seal parts having oblique inner sides.

18. A self-supporting bag as claimed in claim 1 wherein the the bottom part has a fold therein which forms a folded part of a selected width which cooperates with the trunk part to form an approximate W shape.

19. The self-supporting bag of claim 18, wherein grooves are juxtaposed with the ribs.

20. A self-supporting bag as claimed in claim 1 wherein the linear ribs are formed by pressing a positive mold having linear protrusions at the top face against the multilayer plastic film to form linear troughs on the film with decrease of the thickness of the pressed parts of the film and raised parts at the upper edges of the troughs on the film and by fixing the raised parts on the film.

21. A self-supporting bag as claimed in claim 1 wherein additional linear ribs for guiding content are formed on the inner surface of the outlet of the bag.

22. A method of producing a self-supporting bag having a trunk with linear ribs comprising:

providing a multilayer plastic film with an inner layer of a heat adherable plastic having a surface for facing into the bag and an outer layer of a different material;

pressing a positive mold with linear protrusions against the heat adherable plastic of the inner layer to form therein linear troughs between pairs of ribs raised with respect to the surface of the inner layer;

superimposing two sheets of the multilayered plastic film with the inner layers facing one another;

adhering the sheets to one another along seam lines, and cutting the superimposed, adhered sheets at the seam lines to separate the self-supporting bag from the sheets of multilayered plastic film.

23. A method of producing a self-supporting bag having linear is as claimed in claim 22 wherein the inner and outer layers have different melting points and the linear protrusions at the top face of the positive mold are pressed against the layer of the plastic film having the lower melting point while the linear protrusions are heated to a temperature higher than the melting point of the plastic film having the lower melting point and lower than the melting point of the plastic film having the higher melting point.

24. A method of producing a self-supporting bag having linear ribs as claimed in claim 22 wherein the raised ribs on the formed by cooling the film subsequent to forming the ribs.

25. A method of producing a self-supporting bag having linear ribs as claimed in claim 22 including attaching a plastic film for a part constituting a bottom of the bag to end parts of each of the plastic films.

26. A method of production of a self-supporting bag having linear ribs as claimed in claim 21 wherein the multilayer plastic film is made by cutting a long sheet of the multilayer plastic film supplied from a material sheet roll into two sheets in the longitudinal direction.

27. An apparatus for producing self-supporting bags from multilayer plastic film having an inner layer of a heat adherable plastic and an outer layer of another material, comprising:

means for advancing the multilayer plastic film from a supply roll;

a positive mold having a face with linear protrusions for penetrating the heat adherable plastic of the multilayer plastic film to form troughs therein;

means for fixing raised ribs proximate the troughs;

means for superimposing the multilayer plastic film with two inner layers of heat adherable plastic facing one another;

means for inserting a sheet of multilayer plastic film between the superimposed multilayer plastic film;

means for heat sealing the heat adherable plastic layers of the superimposed multilayer plastic film along sealing lines outlining the individual bags; and means for cutting the film at the seal lines to separate the individual bags from the plastic film.

28. An apparatus for producing self-standing bags as claimed in claim 27 wherein the means for fixing the raised ribs on the multilayer plastic film is a cooling mold.

29. An apparatus for producing self-standing bags as claimed in claim 27 wherein a means for attaching a plastic film for the part constituting the bottom of the bag to the end parts of each of two multilayer plastic films having ribs is comprised before or after the means (2).

30. An apparatus for producing self-standing bags as claimed in claim 27 wherein the multilayer plastic film further includes means for cutting the multilayer plastic film supplied from the supply roll into two sheets in the longitudinal direction to provide multilayer plastic film for superimposition.

* * * * *